US012031793B1

(12) United States Patent
Crye

(10) Patent No.: US 12,031,793 B1
(45) Date of Patent: Jul. 9, 2024

(54) FIREARM

(71) Applicant: Caleb Crye, Brooklyn, NY (US)

(72) Inventor: Caleb Crye, Brooklyn, NY (US)

( * ) Notice: Subject to any disclaimer, the term of this patent is extended or adjusted under 35 U.S.C. 154(b) by 0 days.

(21) Appl. No.: 17/398,330

(22) Filed: Aug. 10, 2021

Related U.S. Application Data

(63) Continuation of application No. 16/889,671, filed on Jun. 1, 2020, now Pat. No. 11,105,574.

(51) Int. Cl.
*F41A 9/65* (2006.01)
*F41C 23/16* (2006.01)

(52) U.S. Cl.
CPC ..... *F41A 9/65* (2013.01); *F41C 23/16* (2013.01)

(58) Field of Classification Search
CPC ..... F41A 9/65; F41A 9/61; F41A 9/64; F41A 9/69; F41A 9/70; F41C 23/16
USPC ..... 42/50, 17, 18, 21, 22, 48, 7, 6, 49.01
See application file for complete search history.

(56) References Cited

U.S. PATENT DOCUMENTS 1,398,452 A * 11/1921 Wagnon ..... F41A 9/17 89/194
2,143,331 A * 1/1939 Schultz ..... F41A 9/72 42/21
2,427,304 A * 9/1947 Robbins ..... F41A 19/31 89/149
2,828,568 A * 4/1958 Sakewitz ..... F41A 9/62 42/6
3,372,506 A * 3/1968 Wilhelm ..... F41A 17/38 42/7
4,213,262 A * 7/1980 Badali ..... F41A 9/70 42/50
4,862,618 A 9/1989 Szabo
5,099,595 A * 3/1992 Chesnut ..... F41A 9/69 42/50
5,263,273 A 11/1993 Lishness
5,388,360 A * 2/1995 Fortunato ..... F41A 9/70 42/50
5,477,843 A 12/1995 Kunimoto
(Continued)

FOREIGN PATENT DOCUMENTS

JP 06323786 A 11/1994

OTHER PUBLICATIONS

Search Report and Written Opinion for corresponding patent application No. PCT/US2021/034972, dated Sep. 24, 2021, 10 pages (not prior art).

*Primary Examiner* — John Cooper
(74) *Attorney, Agent, or Firm* — Patterson Intellectual Property Law, P.C.; Ryan D. Levy

(57) ABSTRACT

A compact rifle-caliber firearm is provided herein comprising a receiver body, a barrel, and a grip. The barrel is coupled to the receiver body and extends in a forward direction relative to the receiver body. The barrel includes a bore and a bore axis. The grip is coupled to the receiver body and positioned rearward relative to the barrel. The grip is operable to accept a magazine sized for rifle cartridges. The grip includes a grip depth that is less than or equal to two inches. The compact rifle-caliber firearm may further include a magazine operable to be inserted into the grip and operable to receive rifle cartridges. An interior magazine depth may be less than a length of the rifle cartridges. Rifle cartridges positioned in the magazine may be angled relative to an uppermost cartridge.

20 Claims, 28 Drawing Sheets

(56) References Cited

U.S. PATENT DOCUMENTS

| | | | | |
|---|---|---|---|---|
| 7,530,191 | B2 * | 5/2009 | Szabo | F41A 9/70<br>42/50 |
| 10,139,176 | B1 | 11/2018 | Witecha | |
| 2008/0000129 | A1 * | 1/2008 | Garavaglia | F41A 9/45<br>42/49.01 |
| 2013/0167420 | A1 * | 7/2013 | Zheng | F41A 9/70<br>42/50 |
| 2016/0327354 | A1 * | 11/2016 | DiChario | F41A 9/62 |
| 2019/0264995 | A1 * | 8/2019 | Sharkov | F41A 9/70 |

* cited by examiner

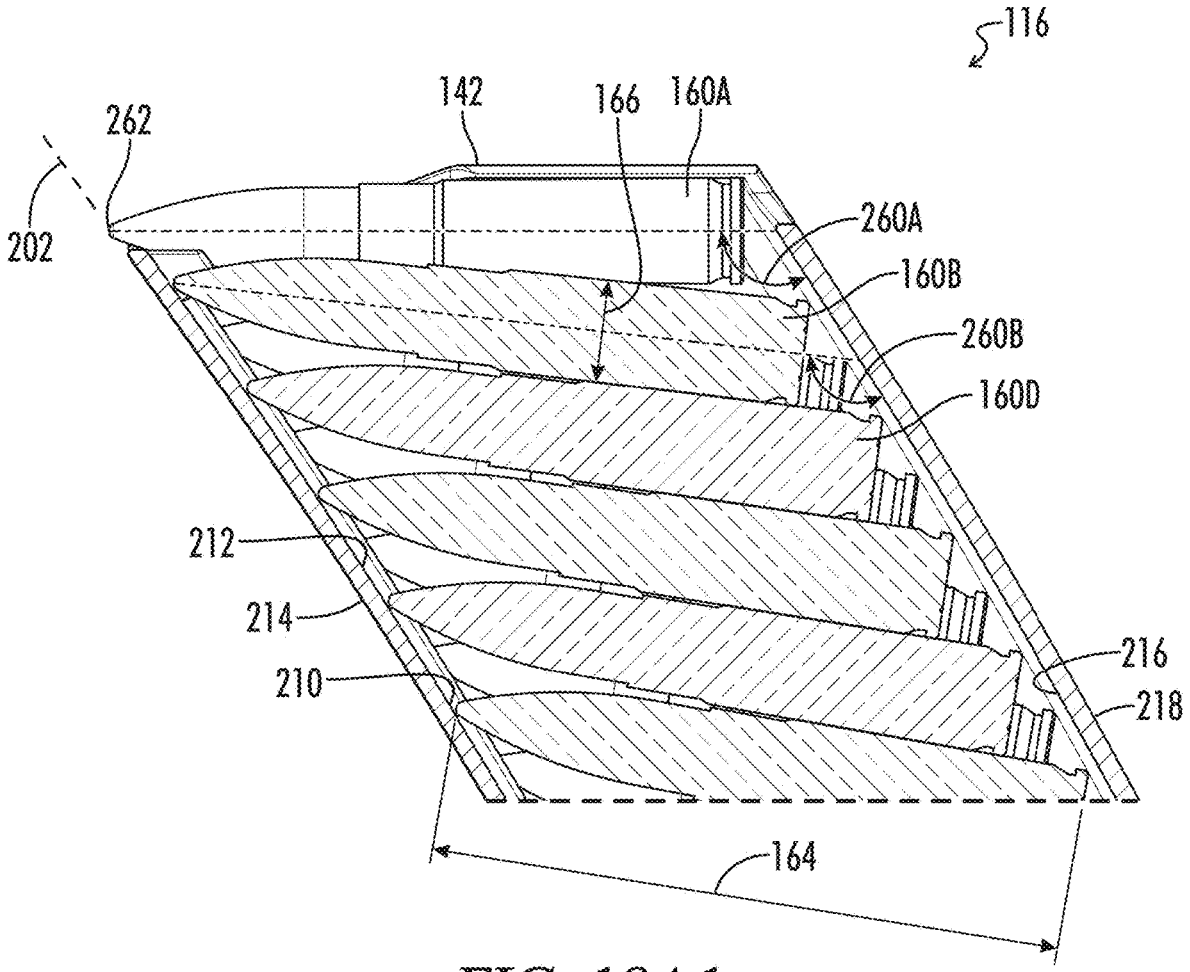
FIG. 18A1

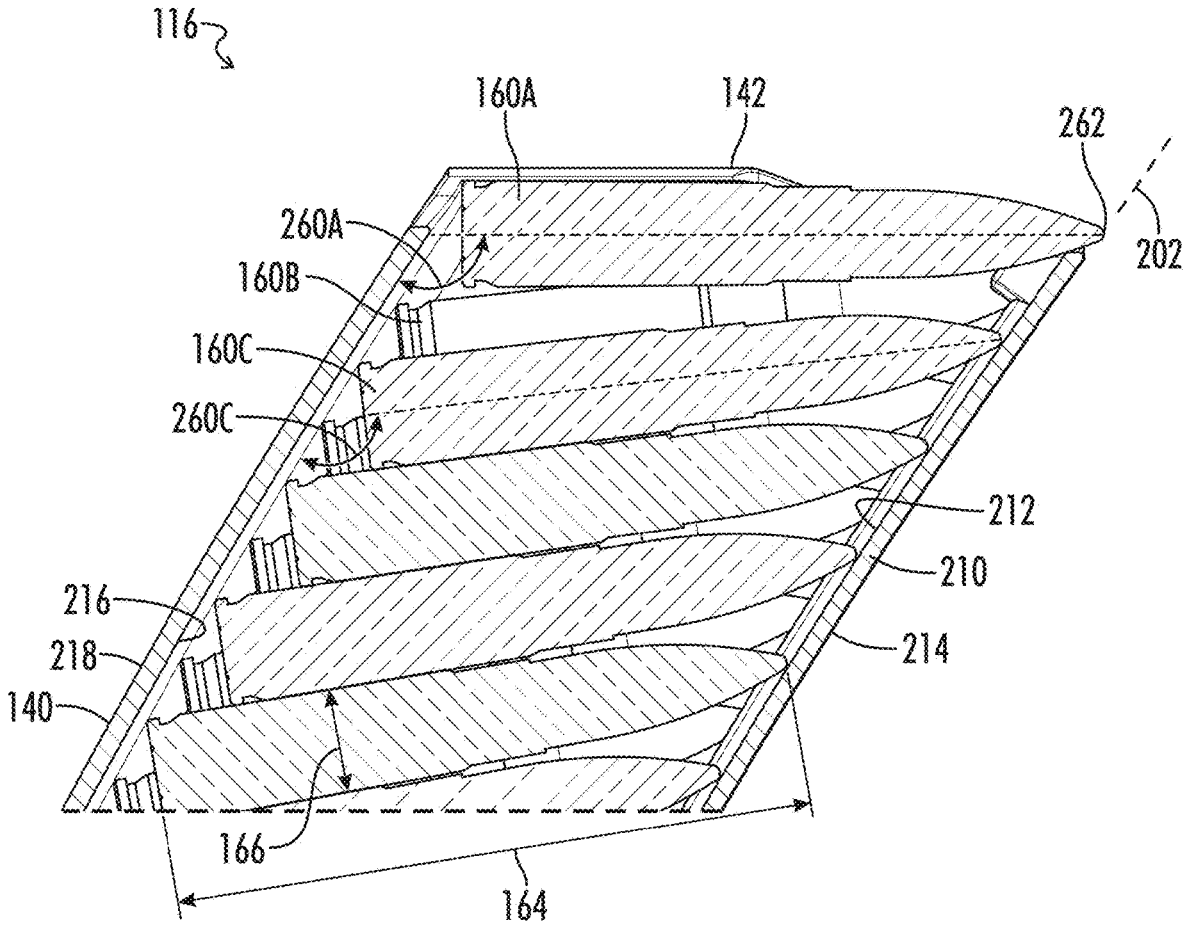
*FIG. 18B1*

Pistol (90)
(Holsterable)

Compact Rifle-Caliber
Firearm (200)
(Holsterable)

Forward-fed
Firearm (10)
(Not Holsterable)

FIREARM

CROSS-REFERENCE TO RELATED APPLICATIONS

The present application is a continuation of and claims priority to and benefit from the following patent application which is hereby incorporated by reference in its entirety: U.S. Non-Provisional patent application Ser. No. 16/889,671 filed Jun. 1, 2020, entitled "Firearm".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present invention relates generally to a rifle-caliber firearm. More particularly, the present invention pertains to a compact rifle-caliber firearm with the magazine received through the main grip.

2. Description of the Prior Art

Magazine-fed rifles comprise the largest market and largest customer base in the United States. This includes the ubiquitous "AR" style firearm. One of the reasons for the success of this market is that most "AR" style firearms utilize 5.56×45 NATO ammunition, .223 Remington ammunition, or .300 AAC Blackout (also known as 300 BLK) ammunition. These types of rifle-caliber ammunition are quite common, well known, and are trusted for their reliability. Many types of rifles are considered to be magazine-fed whereby the ammunition is contained within a magazine which often extends from the firearm. Typical handguns which utilize pistol-caliber ammunition are easier to carry and conceal, but their accuracy, power, and range are inferior to firearms using what are generally understood to be rifle-caliber ammunition. Rifles and handguns chambered for rifle cartridges most often contain the ammunition within a magazine which is received by the firearm either forward (e.g., also known as distal) of the handgrip, rearward (also known as proximal) of the handgrip, or within the handgrip. As used herein, "distal" refers to direction toward muzzle end of the firearm which is generally forward of the handgrip, the term "proximal" refers to a direction toward the buttstock of the firearm which is generally rearward of the handgrip (e.g., a portion of the firearm nearer to the user, in a direction away from the muzzle end.

For example, as can best be seen in FIG. 1, is a representation of a forward-fed firearm 10 with the magazine located distal to the handgrip (e.g., forward of the handgrip). The forward-fed firearm 10 includes a receiver 12, a barrel 14 extending from the forward end of the receiver 12, a handgrip 16 positioned rearward of the barrel 14, a magazine 18 positioned forward of the handgrip 16 and rearward of the barrel 14, and a stock 20 extending rearwardly from the receiver 12. The forward-fed firearm 10 may further include a forward grip 25 positioned forward of the handgrip 16 and below the barrel 14. A stockless length 22 of the forward-fed firearm 10 is measured from the rearward end of the receiver

12 to the forward end end of the barrel 14. An overall length 24 of forward-fed firearm 10 may be measured including the stock 20.

Generally, the traditional way to shorten the length of the forward-fed firearm 10 is by shortening the length of the barrel 14. However, such may have negative effects on the velocity of the cartridges exiting the forward end of barrel 14, which may affect both accuracy and the effective distance of such firearm.

As can best be seen in FIG. 2, a rearward-fed firearm 30 is represented. The rearward-fed firearm 30 may also be referred to herein as a bullpup-style firearm 30. The rearward-fed firearm 30 includes a receiver 32, a barrel 34, a handgrip 36 positioned rearward of the barrel 34, and a magazine 38 positioned rearward relative to both the barrel 34 and handgrip 36. In some optional embodiments, the rearward-fed firearm 30 also includes a forward grip 40 positioned forward relative to the handgrip 36. An overall length 42 of the rearward-fed firearm 30 is typically shorter than the overall length 24 of the forward-fed firearm 10.

As can best be seen in FIG. 3, a representation of a grip-fed firearm 50 is depicted. The grip-fed firearm 50 includes a body 52, a barrel 54, a handgrip 56 extending from the body 52 and positioned rearward relative to the barrel 54, and a magazine 58 received through the handgrip 56. In some optional embodiments, such grip-fed firearm 50 may include a forward grip 60. An overall length 62 of the grip-fed firearm 50 is generally shorter than the overall length 42 of the rearward-fed firearm 30 and the overall length 24 of the forward-fed firearm 10. Notably, grip-fed firearms 50 use shorter cartridges, generally only cartridges traditionally fired by a handgun due to the size constraints of the handgrip 56 and the design of the grip-fed firearm 50.

As can best be seen in FIG. 4, a magazine 18, 38 which may be common to both the forward-fed firearm 10 and rearward-fed firearm 30 is illustrated. The magazine 18, 38 may house a plurality rifle-caliber cartridges 70. The plurality of rifle-caliber cartridges 70 may also be referred to herein as a plurality of rounds 70. The plurality of rifle-caliber cartridges 70 are generally oriented about perpendicularly to the adjacent portion of a rearward wall 72 of the magazine 18, 38. Each cartridge of the plurality of rifle-caliber cartridges 70 generally has a length 174 less than both an interior depth 76 and an exterior depth 78 of the magazine. The interior and exterior depths 76, 78 are defined perpendicularly relative to the rearward wall 72. As can best be seen in FIG. 5A, the barrel 14 of the forward-fed firearm 10 includes a bore 26 that defines a bore axis 28. The plurality of rifle-caliber cartridges 70 are arranged within the magazine 18 parallel to the bore axis 28. Each of the plurality of rifle-caliber cartridges 70 is generally fed into the bore 26 parallel to the bore axis 28 of the barrel 14 and engages a feed ramp (not shown) while being pushed forward by the action (not shown) into the barrel 14. As can best be seen in FIG. 5B, the barrel 34 of the rearward-fed firearm 30 includes a bore 46 that defines a bore axis 48. The plurality of rifle-caliber cartridges 70 are arranged within the magazine 38 parallel to the bore axis 48. Similar to the forward-fed firearm 10, each of the plurality of rifle-caliber cartridges 70 is generally fed into the bore 46 parallel to the bore axis 48 of the barrel 34 and engages a feed ramp (not shown) while being pushed forward by the action (not shown) into the barrel 34.

As can best be seen in FIG. 5C, the magazine 58 of the grip-fed firearm 50 is figured to receive a plurality of pistol-caliber cartridges 80. Additionally, the barrel 54 of the grip-fed firearm 50 includes a bore 66 that defines a bore axis 68. The plurality of pistol-caliber cartridges 80 are arranged within the magazine 58 parallel to the bore axis 68. Similar to the forward-fed firearm 10 and the rearward-fed firearm 30, each of the plurality of pistol-caliber cartridges 80 is generally fed into the bore 66 parallel to the bore axis 68 of the barrel 54 and engages a feed ramp (not shown) while being pushed forward by the action (not shown) into the barrel 54.

As mentioned previously, the grip-fed firearm 50 utilize handgun-caliber ammunition (typically in the range of about 1 inch to about 1.275 inches) which is much shorter than the rifle-caliber ammunition typical used by both the rearward-fed firearm 30 and the forward-fed firearm 10. Rifle-caliber ammunition typically has a length greater than 2 inches. Pistol-caliber ammunition has poorer terminal ballistics (e.g., the behaviour and effects of a projectile when it hits and transfers its energy to a target) than rifle-caliber ammunition due to the size of the projectile and amount of powder used to accelerate it. Using rifle-caliber ammunition with the grip-fed firearm 50 would cause the handgrip to be much too large to be comfortably gripped.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A need exists for a new compact rifle-caliber firearm that is smaller, lighter, more concealable, and more versatile, than those discussed above in the Background section. The compact rifle-caliber firearm includes a magazine that angles the cartridges upwards within the magazine to reduce the depth of the magazine so that it can fit into a handgrip of the firearm so as to function as a handgrip-fed firearm. This allows the overall length of the compact rifle-caliber firearm to be minimized.

The grip of the compact rifle-caliber firearm may be angled also in order to at least partially compensate for the angle of the cartridges within the magazine. The compact rifle-caliber firearm may also feed cartridges from the magazine into the barrel at a chambering angle greater than zero, which is understood to be not parallel to the bore of the barrel.

The compact rifle-caliber firearm as disclosed herein is capable of utilizing the rifle-caliber ammunition. Some examples include 5.56×45 mm NATO, 7.62×39 mm, 7.62×51 mm NATO, 300 AAC Blackout, as well as other 6.5 mm variants, 0.50 variants, 0.300 variants, and 0.338 variants. In some optional embodiments, the rifle-caliber firearm as disclosed herein may be approximately four (4) inches shorter than comparable forward-fed and rearward-fed firearms with a magazine received either forward or rearward relative to the handgrip, respectively. The compact rifle-caliber firearm as disclosed herein provides several advantages over the forward-fed and rearward-fed firearms disclosed previously, namely, the compact rifle-caliber firearm has a better center of gravity for single handed use and the configuration allows for holstering of the firearm, which isn't possible for forward-fed and rearward-fed firearms.

One optional aspect includes a compact rifle-caliber firearm. The compact rifle-caliber firearm may comprise a receiver body, a barrel, and a grip. The barrel may be coupled to the receiver body and may extend in a forward direction relative to the receiver body. The barrel may include a bore with a bore axis. The grip may be coupled to the receiver body and positioned rearward relative to the barrel. The grip may be operable to accept a magazine sized for rifle cartridges. The grip may include a grip depth being greater than or equal to two inches.

According to another optional aspect of the compact rifle-caliber firearm, the grip depth is less than or equal to a rifle cartridge length of at least one rifle cartridge sized for the compact rifle-caliber firearm.

According to another optional aspect of the compact rifle-caliber firearm, a grip width of the grip is greater than to a rifle cartridge diameter of at least one rifle cartridge sized for the compact rifle-caliber firearm and less than or equal to three times the rifle cartridge diameter.

According to another optional aspect of the compact rifle-caliber firearm, at least one of the rifle cartridges sized for the compact rifle-caliber firearm has a rifle cartridge diameter of greater than about 9.5 millimeters and the grip depth of the grip is less than or equal to about 60 millimeters.

According to another optional aspect of the compact rifle-caliber firearm, the compact rifle-caliber firearm further comprises a magazine operable to be received through the grip and contain the rifle cartridges. The magazine may be operable to position a first rifle cartridge in contact with and about parallel to feed lips of the magazine.

According to another optional aspect of the compact rifle-caliber firearm, the feed lips of the magazine may be positioned at a chambering angle relative to the bore axis when the magazine is received through the grip. The chambering angle may be between about zero (0) degrees and about ten (12) degrees According to another optional aspect of the compact rifle-caliber firearm, the magazine may be operable to position the second rifle cartridge angled relative to the first rifle cartridge.

According to another optional aspect of the compact rifle-caliber firearm, the magazine is operable to position the second rifle cartridge angled from about zero-point-five (0.5) degrees to about ten (10) degrees relative to the first rifle cartridge.

According to another optional aspect of the compact rifle-caliber firearm, the magazine is operable to position a third rifle cartridge angled from about one (1) degree to about eleven (11) degrees relative to the first rifle cartridge.

According to further optional aspects of the present disclosure, there is provided an embodiment of a magazine for a compact rifle-caliber firearm. The magazine may comprise a magazine operable to be inserted within a grip of the compact rifle-caliber firearm and operable to receive rifle cartridges. The magazine may include a forward wall, a rearward wall, feed lips, an exterior magazine depth, and an interior magazine depth. The forward wall may include an interior forward wall surface and an exterior forward wall surface. The rearward wall may include an interior rearward wall surface and an exterior rearward wall surface. The feed lips may be positioned at a feed lip angle relative to an uppermost portion of the rearward wall. The exterior magazine depth may be defined between the exterior forward wall surface and the exterior rearward wall surface. The interior magazine depth may be defined between the interior forward wall surface and the rearward interior wall surface. The interior magazine depth may be less than a cartridge length of at least one of the rifle cartridges the magazine is operable to receive According to another optional aspect of the magazine, the exterior magazine depth may be less than the cartridge length of at least one of the rifle cartridges the magazine is operable to receive.

According to another optional aspect of the magazine, the interior magazine depth may be less than about 57 millimeters.

According to another optional aspect of the magazine, the magazine may be operable to receive a first cartridge about parallel to the feed lips and a second cartridge angled greater than about zero-point-five (0.5) degrees relative to the feed lips.

According to another optional aspect of the magazine, the magazine may be operable to receive a third cartridge angled greater than about one (1) degree relative to the feed lips.

According to another optional aspect of the magazine, the magazine may be operable to receive the first cartridge about parallel to the feed lips, the second cartridge angled greater than one (1) degree relative to the feed lips, and the third cartridge angled greater than about one-point-five (1.5) degree relative to the feed lips.

According to another optional aspect of the magazine, the magazine may further comprise a follower. The follower may include a upper surface angled from about thirty-five (35) degrees to about forty-five (45) degrees relative to the interior rearward wall surface.

According to another optional aspect of the magazine, the upper surface of the follower may include a fixed angle forward portion and a pivotal rearward portion biased to align with the feed lips of the magazine. In accordance with this aspect, the fixed angle forward portion may be angled relative the feed lips relative to the interior rearward wall surface of the magazine.

According to another optional aspect of the magazine, the magazine may be operable to position a first cartridge about parallel to the feed lips with a distal tip of the cartridge extending beyond the forward interior wall surface.

According to another optional aspect of the magazine, the magazine may be operable to position a first cartridge about parallel to the feed lips with a distal tip of the cartridge even with or extending beyond the forward exterior wall surface.

According to another optional aspect of the magazine, the feed lip angle may be less than a summation of ninety (90) degrees and a sinusoidal function of the interior depth divided by the cartridge length.

According to another optional aspect of the magazine, the magazine may be operable to angle at least some rifle cartridges relative to the feed lips with successive rifle cartridges of the at least some rifle cartridges angled at a greater angle than preceding rifle cartridges.

According to another optional aspect of the magazine, the successive rifle cartridges may be angled at about zero-point-five (0.5) degrees greater than the preceding rifle cartridges.

According to further optional aspects of the present disclosure, there is provided a further embodiment of compact rifle-caliber firearm. The compact rifle-caliber firearm may comprise a receiver body, a barrel, a pistol grip, and a magazine. The barrel may be received by the receiver body and includes a bore axis. The pistol grip may be coupled to the receiver body and is positioned proximal to the barrel. The pistol grip may be angled proximally with grip angle relative to the bore axis. The magazine may be configured to be received through the pistol grip. The magazine may include a rearward wall and may be configured to receive one or more cartridges. An uppermost cartridge of the one or more cartridges may be received by the magazine at a cartridge angle relative to the rearward wall of the magazine. A chambering angle may be understood to be the angle of the uppermost cartridge of the magazine relative to the bore axis of the barrel when the magazine is received within the pistol grip. The chambering angle may be an angle in a range from about 7 degrees to about 20 degrees.

According to another optional aspect of the compact rifle-caliber firearm, the chambering angle may be substantially equal to the grip angle minus cartridge angle.

According to another optional aspect of the compact rifle-caliber firearm, a cartridge length of a cartridge may be greater than or equal to about 2 inches.

According to another optional aspect of the compact rifle-caliber firearm, the grip angle may be greater than the cartridge angle.

According to another optional aspect of the compact rifle-caliber firearm, the cartridge angle may be in a range from about 45 degrees to about 58 degrees.

According to another aspect of the compact rifle-caliber firearm, the grip angle may be in a range from about 58 degrees to about 71 degrees.

According to another optional aspect of the compact rifle-caliber firearm, the compact rifle-caliber firearm may further comprise a trigger coupled to the receiver body and positioned distal to and forward of the pistol grip.

According to another optional aspect of the compact rifle-caliber firearm, the magazine may include an interior depth defined perpendicular to the rearward wall. Also, each of the one or more cartridges may include a cartridge length. Further, in accordance with this aspect, the interior depth of the magazine may be greater than or equal to about 115% of the cartridge length multiplied by the sine function of the cartridge angle.

According to another optional aspect of the compact rifle-caliber firearm, the cartridge length may be greater than or equal to 2 inches and may be less than the interior depth of the magazine divided by a sine function of the cartridge angle.

According to another optional aspect of the compact rifle-caliber firearm, the magazine may include an exterior magazine width defined perpendicular to the rearward wall. In accordance with this aspect, the at least one cartridge has a cartridge length greater than the exterior magazine width.

According to another optional aspect of the compact rifle-caliber firearm, the one or more cartridges may include a plurality of cartridges positioned in a single stack configuration within the magazine.

According to another optional aspect of the compact rifle-caliber firearm, an angle of one or more cartridges positioned below the uppermost cartridge receivable by the magazine may be less than or equal to the cartridge angle.

According to another optional aspect of the compact rifle-caliber firearm, the magazine may be straight.

According to another optional aspect of the compact rifle-caliber firearm, the magazine may be curved. In accordance with this aspect, the cartridge angle may be defined relative to a tangent of the rearward wall in contact with the uppermost cartridge.

According to further optional aspects of the present disclosure, there is provided a further embodiment of a compact rifle-caliber firearm. The compact rifle-caliber firearm may comprise a receiver body, a barrel, a pistol grip, and a magazine. The barrel may be received by the receiver body and extends distally from the receiver body. The barrel also includes a bore with a bore axis. The pistol grip may be coupled to the receiver body and is positioned proximally to the barrel. The pistol grip may extend downwardly and proximally from the receiver body at a grip angle relative to the bore axis. The pistol grip may include a magazine passageway extending between a lowermost end of the pistol grip and the receiver body. The magazine may be received within the magazine passageway of the pistol grip. The magazine may be configured to receive a plurality of cartridges. Each cartridge of the plurality of cartridges may have a length greater than or equal to 2 inches. The plurality of cartridges may be angled within the magazine at a cartridge angle less than the grip angle relative to a rearward wall of the magazine. The top cartridge of the plurality of cartridges defines a chambering angle greater than zero relative to the bore axis.

According to another optional aspect of the compact rifle-caliber firearm, the magazine may include an exterior magazine width defined perpendicular to the rearward wall. In accordance with this aspect, the length of each of the plurality of cartridges may be greater than or equal to the exterior magazine width.

According to further optional aspects of the present disclosure, there is provided a magazine for a compact rifle-caliber firearm. The magazine comprises a magazine body, a rearward wall, an interior depth defined perpendicularly relative to the rearward wall, and feed lips extending at a cartridge angle relative to a portion of the rearward wall proximate to the feed lips. The cartridge angle may be in a range of about 45 degrees to 58 degrees. The interior depth may be greater than or equal to 1.5 inches. The magazine body may be configured to receive a plurality of cartridges. Each cartridge of the plurality of cartridges may have a length greater than the interior depth divided by the sine of the cartridge angle. Additionally, an uppermost cartridge of the plurality of cartridges, when received by the magazine body, may be angled parallel to the cartridge angle.

According to another optional aspect of the magazine, the magazine may further comprises a follower and a resilient spring. The follower may be positioned within the magazine body. The follower may include an upper surface configured at an upper surface angle that may be substantially similar to the cartridge angle. According to another optional aspect of the magazine, the rearward wall of the magazine body may be straight.

According to further aspects optional aspects, there is provided another embodiment of a compact rifle-caliber firearm. The compact rifle-caliber firearm may comprise a receiver body, a barrel, a trigger, a grip, and a magazine. The barrel is coupled to the receiver body with a majority of the barrel positioned within an interior of the receiver body. The barrel includes a bore with a bore axis. The trigger extends from and below the receiver body. The grip extends from and below the receiver body adjacent to the trigger. The grip may be positioned proximally to both the trigger and the barrel. The grip may include a lower end, an upper end, and a magazine passageway defined between the lower end and the upper end such that the magazine passageway is in communication with the interior of the receiver body. The magazine passageway may also extend downwardly and proximally from the receiver body at a grip angle relative to the bore axis of the barrel. The magazine may be insertable within the magazine passageway. The magazine includes at least a rearward wall, an interior depth defined perpendicularly relative to the rearward wall, and feed lips extending at a cartridge angle relative to a portion of the rearward wall proximate to the feed lips. The cartridge angle is in a range of 45 degrees to 58 degrees, the interior depth is greater than or equal to 1.5 inches, and the cartridge angle is at least five (5) degrees less than the grip angle.

According to another aspect of the compact rifle-caliber firearm, the difference between the grip angle and the cartridge angle may define a chambering angle greater than or equal to five (5) degrees.

According to another aspect of the compact rifle-caliber firearm, the compact rifle-caliber firearm further comprises at least one cartridge received by the magazine. The at least one cartridge may be configured to be fed into the barrel at the chambering angle before aligning with the bore axis.

According to another aspect of the compact rifle-caliber firearm, the at least one cartridge may include a length greater than the interior depth divided by the sine function of the cartridge angle.

BRIEF DESCRIPTION OF THE SEVERAL VIEWS OF THE DRAWINGS

FIG. 18A1 is an enlarged cross-sectional left side elevation view of the magazine of FIG. 18A taken of area 18A1 shown in FIG. 18A.

FIG. 18B1 is an enlarged cross-sectional right side elevation view of the magazine of FIG. 18B taken of area 18B1 shown in FIG. 18B.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 6:
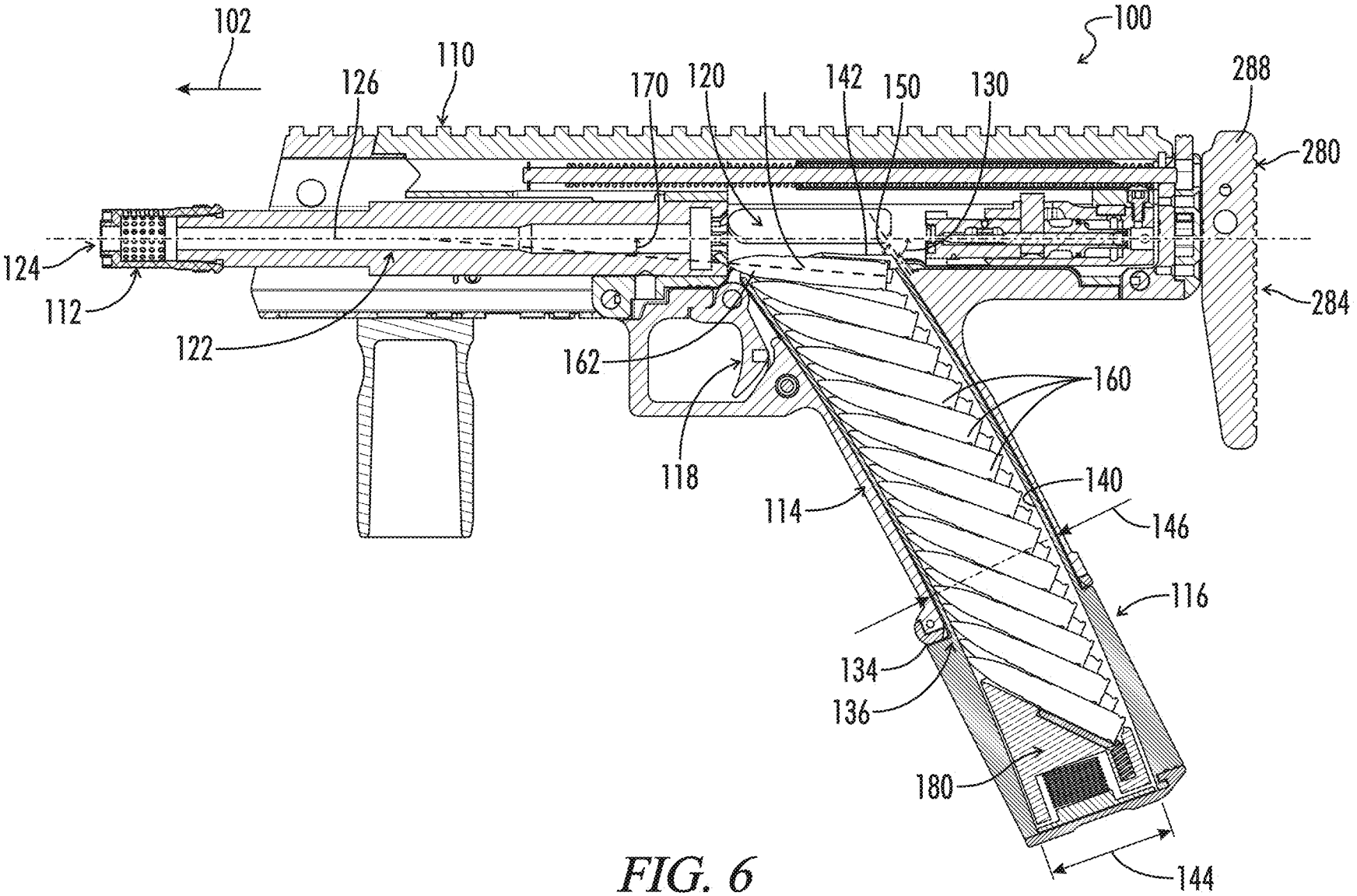
FIG. 6 is a cross-sectional side elevation diagram of a compact rifle-caliber firearm in accordance with the present disclosure.

Referring to FIG. 6, a compact rifle-caliber firearm 100 is provided. The compact rifle-caliber firearm 100 may also be referred to herein as a compact rifle system 100, a compact rifle 100, a compact carbine 100, or a compact rifle-caliber grip-fed firearm 100. The compact rifle-caliber firearm 100 includes a receiver body 110, a barrel 112, a grip 114, and a magazine 116. The grip 114 may also be referred to herein as a handle 114, a magazine-fed grip 114, or a pistol grip 114. The grip 114 is positioned adjacent to and rearward relative to a trigger 118 of the compact rifle-caliber firearm 100.

The barrel 112 may be coupled to the receiver body 110. More particularly, the barrel 112 may be coupled within an interior 120 of the receiver body 110 and may extend distally relative to the receiver body 110 in a forward direction 102. A majority 122 of the barrel 112 may be positioned within the interior 120 of the receiver body 110 in order to minimize a length of the compact rifle-caliber firearm 100 in certain optional embodiments. Accordingly, either a minority or none of the barrel may be positioned distally and outside of the receiver body 110 in certain optional embodiments. However, in other optional embodiments, a significant portion of the barrel 112 may extend from the receiver body 110 in the forward direction 102. The barrel 112 includes a bore 124 defined therethrough. The bore axis 126 is the longitudinal axis which goes through the center of the barrel 112 and bore 124.

The grip 114 is coupled to the receiver body 110 and is positioned rearwardly relative to the barrel 112. In some optional embodiments, grip 114 may be formed as a portion of receiver body 110. The grip 114 may extend downwardly and proximally from the receiver body 110 at a grip angle 130 relative to the bore axis 126. The grip 114 includes include a magazine passageway 132 extending from a lower end 134 of the grip 114 and being in communication with the interior 120 of the receiver body 110.

Figure 21:
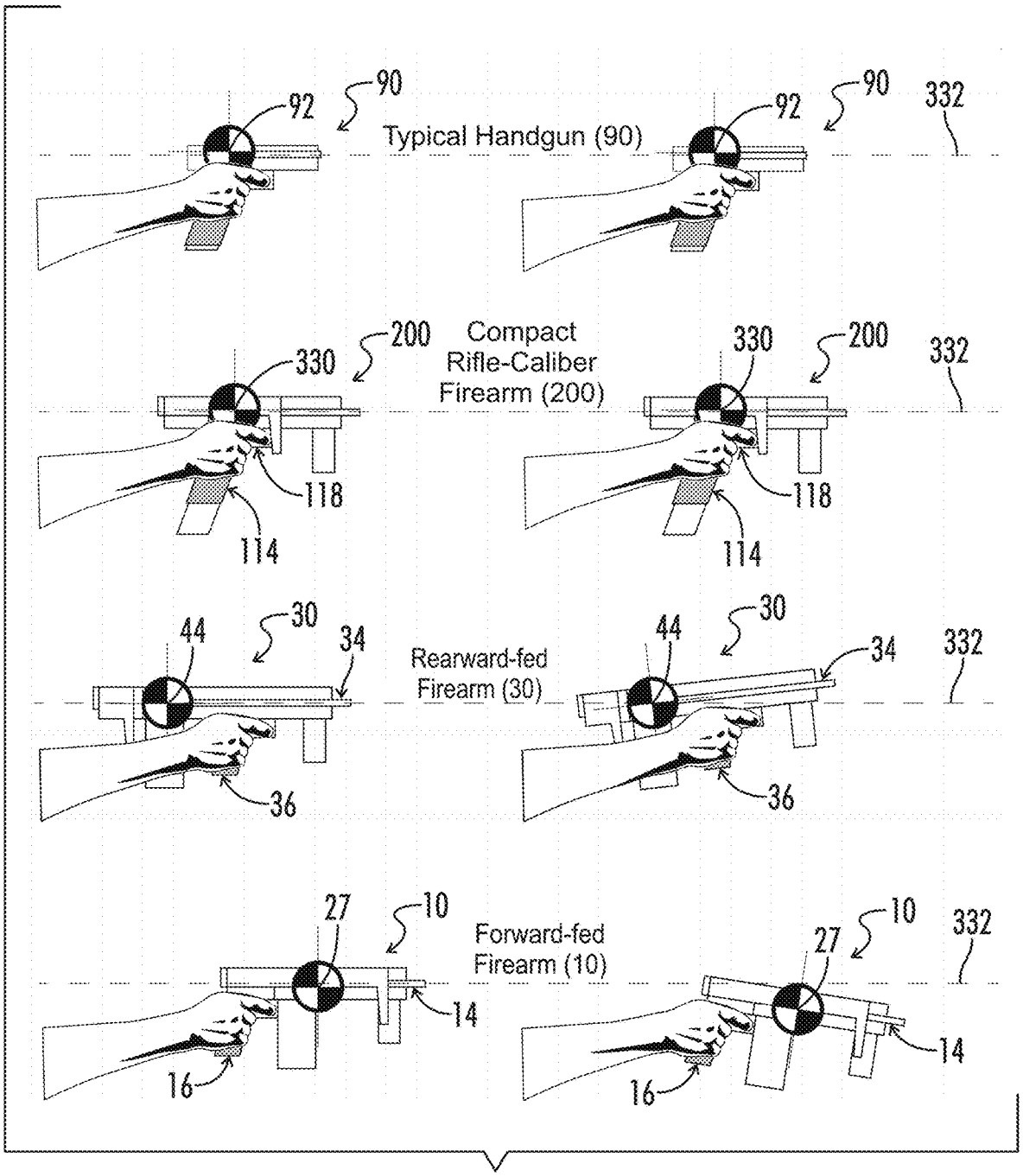
FIG. 21 is comparison of the position of the respective balance points for the compact rifle-caliber firearm of FIG. 9, the forward-fed firearm of FIG. 1, the rearward-fed firearm of FIG. 2, and a pistol 90.
Figure 22:
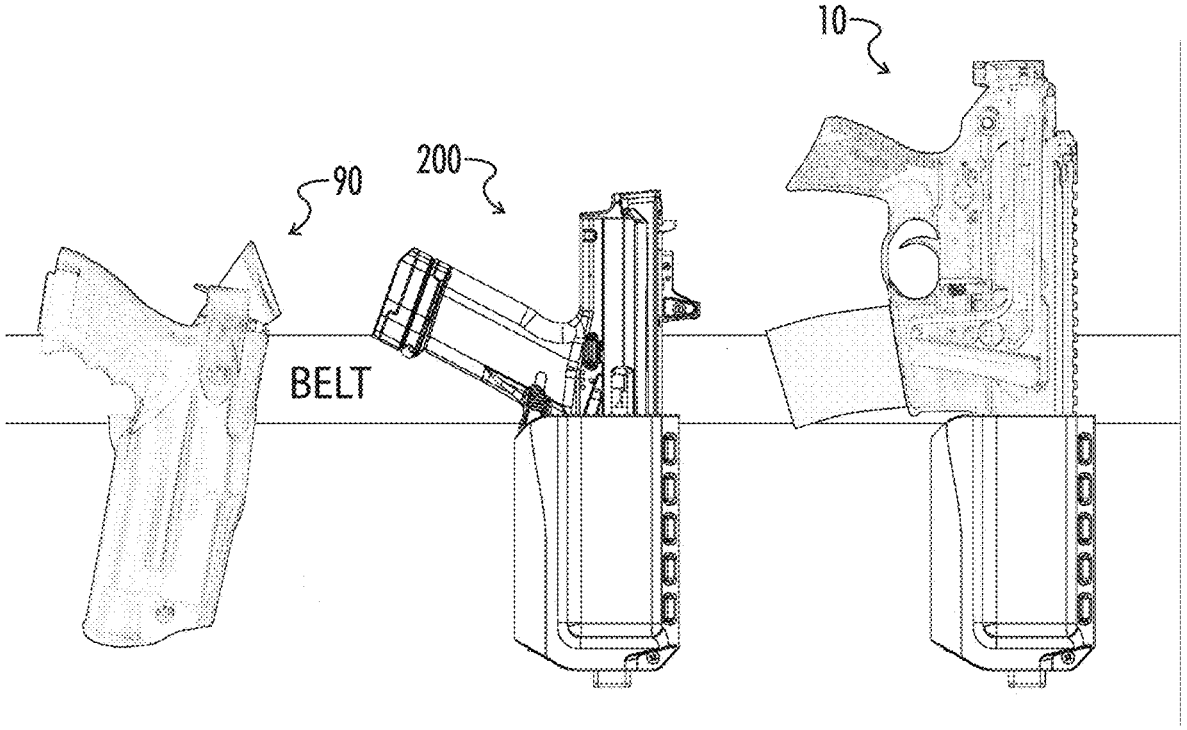
FIG. 22 is a comparison of each of the compact rifle-caliber firearm of FIG. 9, the forward-fed firearm of FIG. 1, and the pistol of FIG. 21 positioned in holsters.

The magazine 116 of the compact rifle-caliber firearm 100 is configured to be received through the magazine passageway 132 of the grip 114 and be accessible within the interior 120 of the receiver body 110. As can best be seen in FIG. 7, the magazine 116 includes a rearward wall 140, feed lips 142 positioned at an upper end of the magazine 116, an interior depth 144 defined perpendicularly relative to the rearward wall 140, and an exterior depth 146 also defined perpendicularly relative to the rearward wall 140. The interior depth 144 may also be referred to herein as an interior magazine depth 144, and the exterior depth 146 may also be referred to herein as an exterior magazine depth 146. The interior depth 144 of the magazine may be greater than or equal to 1.5 inches. The feed lips 142 may optionally extend at cartridge angle 150 relative to an upper portion 148 of the rearward wall 140. An advantage of receiving the magazine through the grip 114 is that the compact rifle-caliber firearm 100 has a better center of gravity than forward-fed or rearward-fed firearms, as previously discussed and as shown in FIG. 21. The compact size of the compact rifle-caliber firearm 100 and the position of the magazine 116 allows the firearm to be easily holstered, as shown in FIG. 22-23C.

The magazine 116 is configured to receive one or more cartridges 160, and more often than not, the magazine 116 may receive a plurality of cartridges. Accordingly, the one or more cartridges 160 may be referred to herein as at least one cartridge 160 or a plurality of cartridges 160. An uppermost cartridge 162 of the one or more cartridges 160 received by the magazine 116 may be aligned with the cartridge angle 150 using the feed lips 142. Each cartridge of the one or more cartridges 160 includes a cartridge length 164 and a cartridge diameter 166. The cartridge length 164 may also be referred to herein as a length 164. The one or more cartridges 160 are of a rifle-caliber with the cartridge length 164 thereof being greater than or equal to two (2) inches. When the one or more cartridges 160 are 5.56×45 NATO ammunition, .223 Remington ammunition, or .300 AAC Blackout (also known as 300 BLK) ammunition, the cartridge length 164 is generally about two-point-two-six (2.26) inches. Likewise, for said ammunition, the cartridge diameter 166 is generally about 0.378 inch (or 9.8 mm). Other ammunition such as 7.62×39 mm, 7.62×51 mm NATO, as well as other 6.5 mm variants, 0.50 variants, 0.300 variants, and 0.338 variants may have different cartridge lengths and/or diameters 164, 166, when used with other optional embodiments of the compact rifle-caliber firearm 100. The cartridge length 164 of the one or more cartridges 160 may be greater than both the interior depth 144 and the exterior depth 146 of the magazine 116 due to the cartridge angle 150. The cartridge length 164 of the one or more cartridges 160 may be greater than 85% of the following: the interior depth 144 of the magazine 116 divided by the sine function of the cartridge angle 150. In some embodiments, the cartridge diameter 166 is generally greater than or equal to about 9.5 mm and the cartridge length 164 is generally greater than or equal to about 77 mm.

Angling the one or more cartridges 160 within the magazine 116 allows the exterior depth 146 of the magazine 116 to be minimized so that the magazine 116 can fit within the magazine passageway 132 of the grip 114 without making the grip 114 too large so as to be uncomfortable or unreasonable to use in a single-handed situation. Both the interior and exterior depths 144, 146 of the magazine 116 are smaller than the interior and exterior depths 76, 78 of the magazine 18, 38 as described above due to the angling of the one or more cartridges 160 within the magazine 116.

In some optional embodiments, the cartridge angle 150 is generally less than the grip angle 130. More particularly, the cartridge angle 150 may be as must as twelve (12) degrees less than the grip angle 130. The grip angle 130 may be in a range from about fifty-eight (57) degrees to about seventy-one (71) degrees. The cartridge angle 150 may be in a range from about forty-five (45) degrees to about fifty-eight (59) degrees.

As can best be seen in FIG. 6, the uppermost cartridge 162 of the one or more cartridges received by the magazine 116 defines a chambering angle 170 relative to the bore axis 126 of the barrel 112 when the magazine 116 is received in the magazine passageway 132. The uppermost cartridge 162 of the at least one cartridge 160 may be fed into the barrel 112 at the chambering angle 170 before aligning with the bore axis 126 of the barrel 112. An "action" of the compact rifle-caliber firearm 100 may be used to move the uppermost cartridge 162 from the magazine 116 into the bore 124 of the barrel 112 for firing. The chambering angle 170 may in some optional embodiments be substantially equal to the grip angle 130 minus the cartridge angle 150. Additionally, in certain optional embodiments, the chambering angle 170 may be in a range of from about zero (0) degrees to about twenty (20) degrees. In other optional embodiments, the chambering angle 170 may be in a range from about zero (0) degrees to about twelve (12) degrees. In still further optional embodiments, the chambering angle 170 may be in a range from about zero (0) degrees to about five (5) degrees.

As can best be seen in FIGS. 7A-8B, the magazine 116 may further include a dual action follower 180 positioned within the magazine and configured to push the one or more cartridges 160 received by the magazine toward the feed lips 142 of the magazine. The dual action follower 180 may also be referred to herein as a follower 180. The dual action follower 180 includes an upper surface 182 angled relative to the interior rearward wall surface of the magazine 116, steeper than the angle of the feed lips 142, which is relative to the upper portion 148 of the rearward wall 140. The upper surface 182 includes a fixed angle forward portion 184 and a pivotal rearward portion 186.

The pivotal rearward portion is biased to not align with the fixed angle forward portion (i.e., to be aligned with the angle of the feed lips 142) using a rearward portion spring 188 positioned beneath the pivotal rearward portion. The pivotal rearward portion, when the magazine 116 is loaded with a plurality of cartridges 160, is configured to compress the rearward portion spring so that the pivotal rearward portion is aligned, angularly, with the fixed angle forward portion. The dual action follower 180 may further include a stopper portion 190 configured to interact with the pivotal rearward portion to ensure that the pivotal rearward portion cannot extend to an angle greater than that of the feed lips 142. In other optional embodiments, the pivotal rearward portion may be biased to align with the fixed angle forward portion, which may be aligned with the angle of the feed lips 142, and when the rearward portion spring 188 is compressed be configured to be angled steeper than the angle of the feed lips 142.

A pusher spring 192 of the magazine 116 may be configured to push the dual action follower 180 toward the feed lips 142 of the magazine. The pusher spring may be positioned closer to the forward wall of the magazine than to the rearward wall 140, rather than spanning the entire interior depth 144 of the magazine. In certain optional embodiments, rather than being a full width AR spring, the pusher spring 192 may be a handgun sized spring, utilizing the free space near the forward portion of the dual action follower 180 created by the steep angle of the upper surface 182.

Figure 7A:
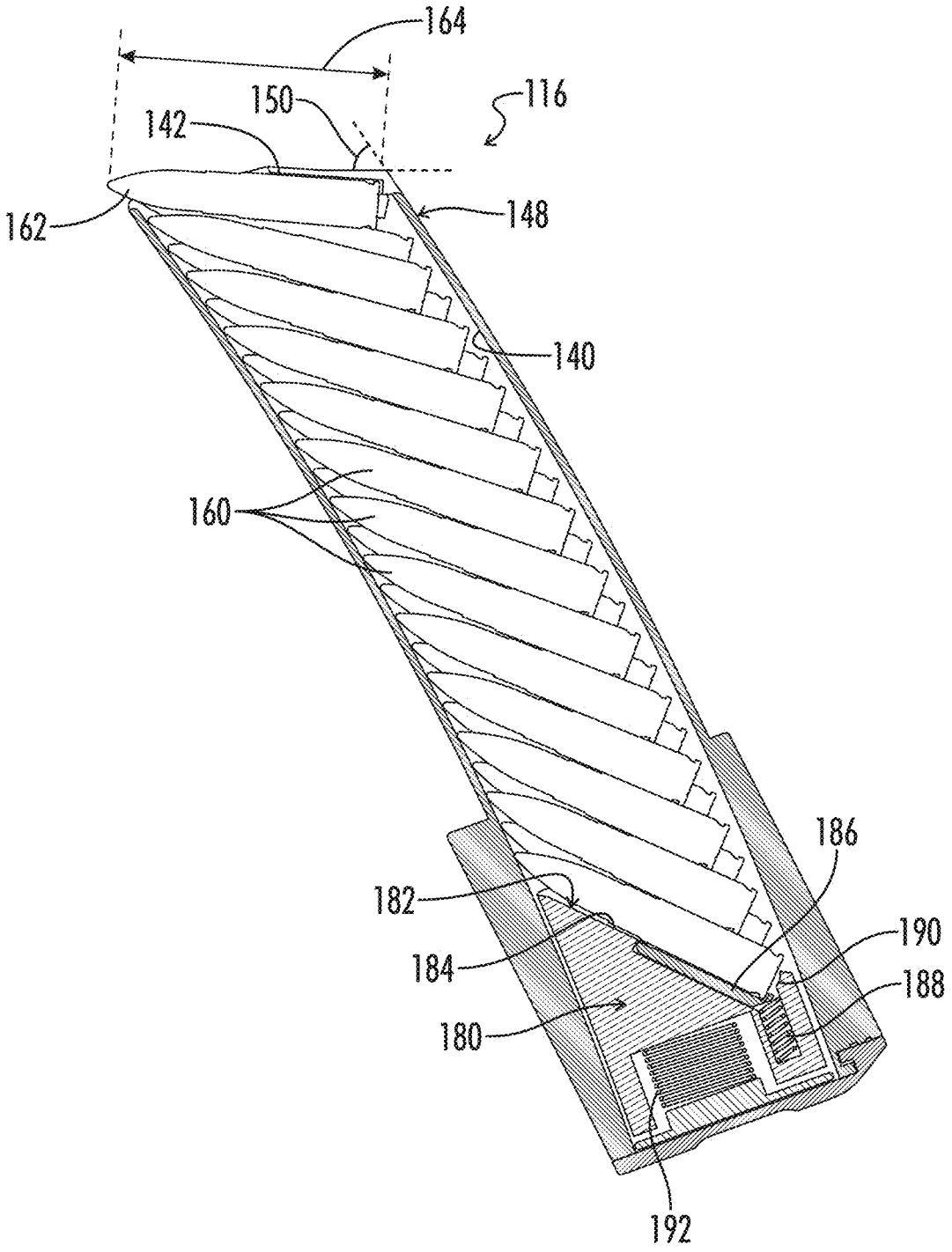
FIG. 7A is a cross-sectional side elevation diagram of the magazine of the compact rifle-caliber firearm of FIG. 5 with a plurality of cartridges loaded therein in accordance with the present disclosure.

As can best be seen in FIG. 7A, when the magazine 116 is loaded with cartridges 160, the pivotal rearward portion is configured to match the angle or align with the fixed angle forward portion when one cartridge remains in the magazine. As can best be seen in FIG. 8A, the pivotal rearward portion 186 is configured to be positioned at a less steep angle than the fixed angle forward portion 184 (e.g., an angle closer to that of the feed lips 142 relative to the upper portion 148 of the rearward wall 140). The rearward portion spring 188 may become less and less depressed as fewer and fewer cartridges remain in the magazine. In certain optional embodiments, the angle of pivotal rearward portion closely aligns with the angle of the feed lips when four or less cartridges remain in the magazine.

Figure 7B:
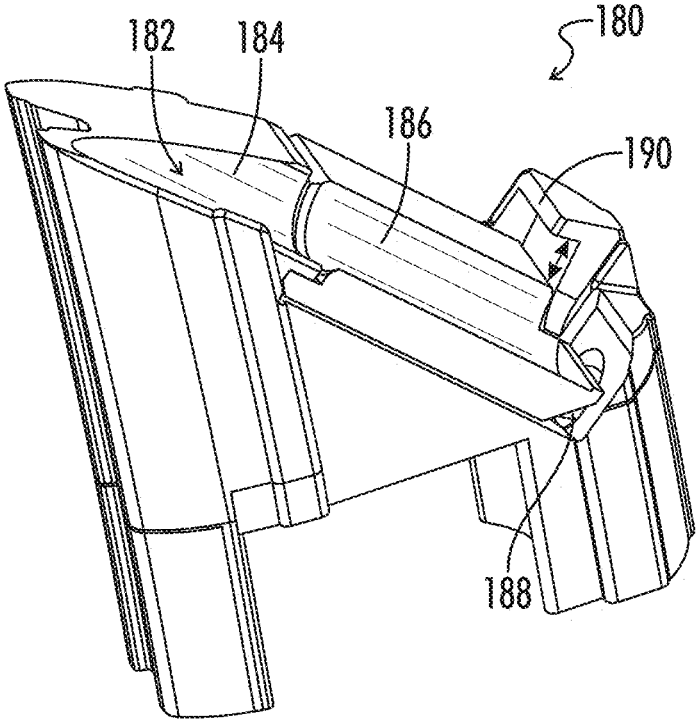
FIG. 7B is a perspective view of the follower of the magazine of FIG. 7A with a pivotal rearward portion in a compressed position.
Figure 8A:
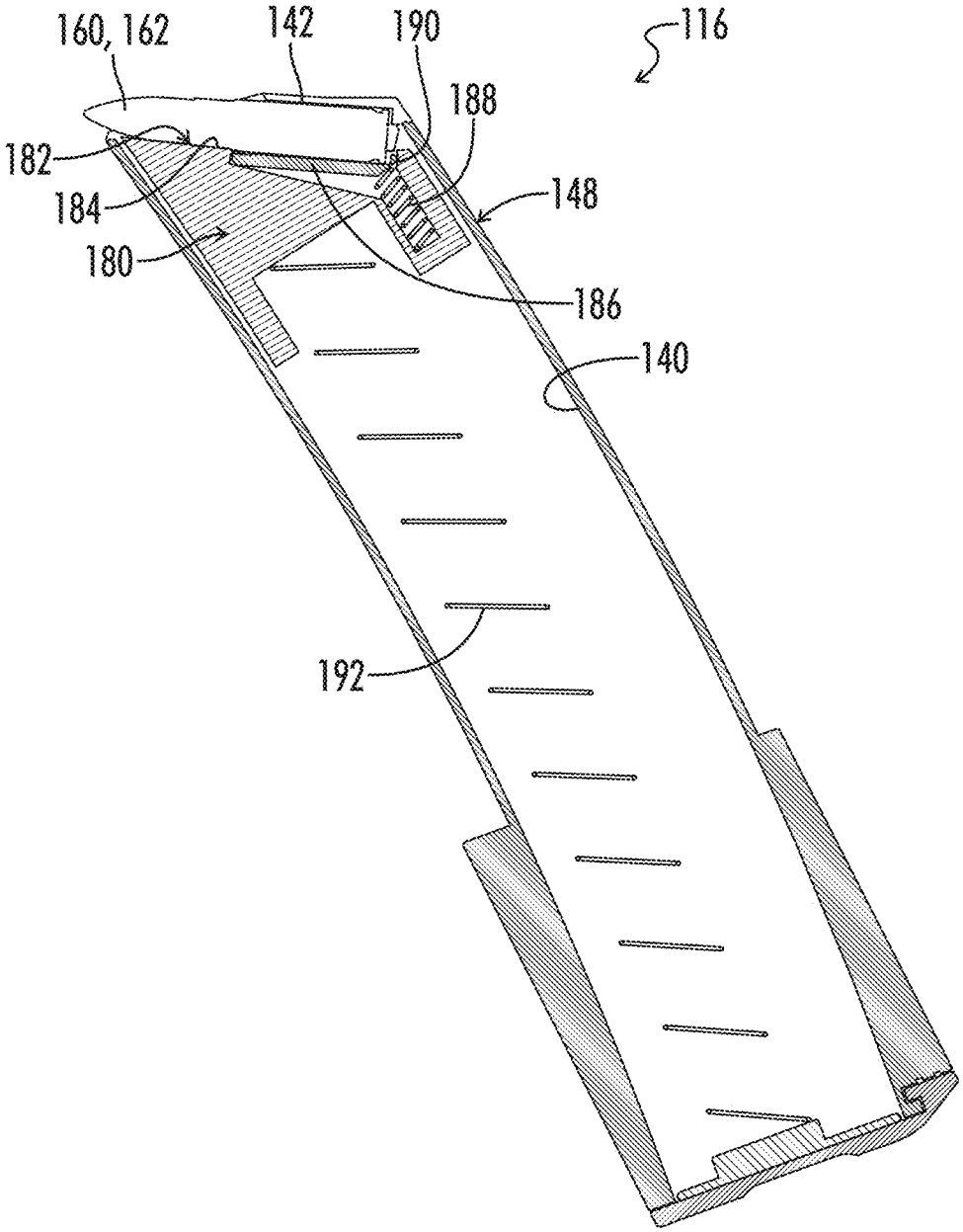
FIG. 8A is a cross-sectional side elevation diagram of the magazine of the compact rifle-caliber firearm of FIG. 5 with one cartridge loaded therein.
Figure 8B:
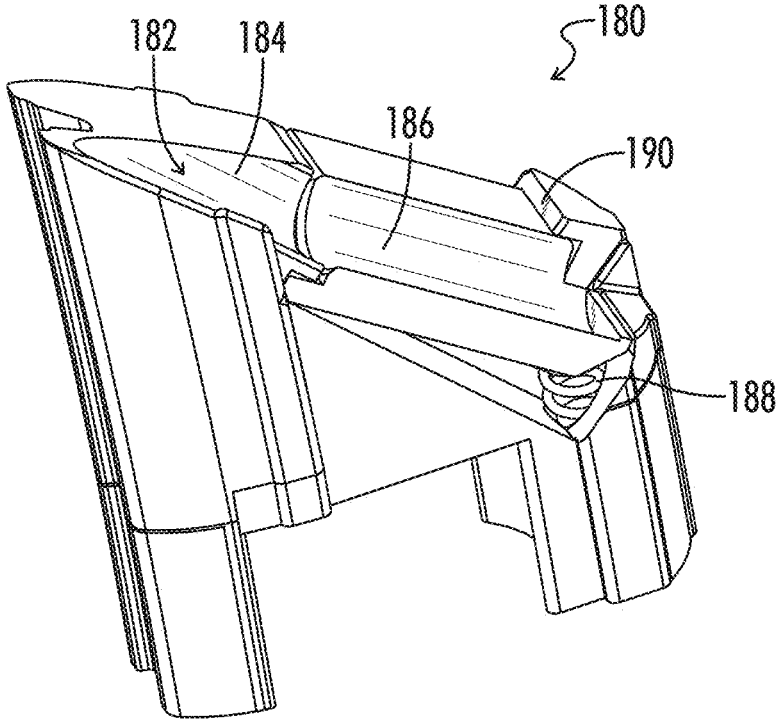
FIG. 8B is a perspective view of the follower of the magazine of FIG. 8A with the pivotal rearward portion in a non-compressed position
Figure 9:
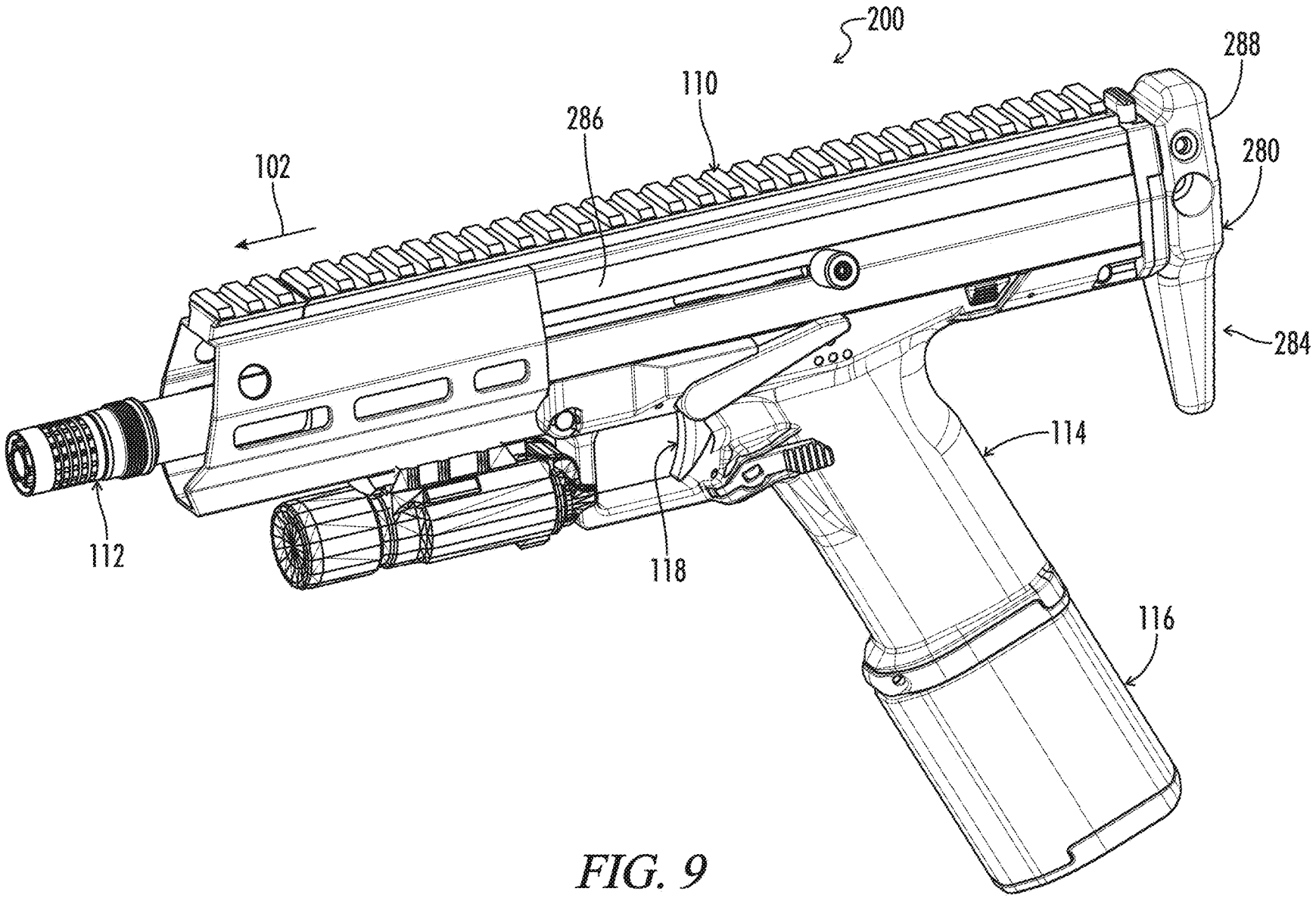
FIG. 9 is a perspective view of a compact rifle-caliber firearm in accordance with the present disclosure.

As can best be seen in FIGS. 7B and 8B, each of the fixed angle forward portion 184 and the pivotal rearward portion 186 includes a flat portion (e.g., right portion) and a curved portion (e.g, left portion). The curved portion is configured to interact with and receive a lowermost cartridge of the at least one cartridge 160 received by the magazine 116. In certain optional embodiments, only the flat portion of the pivotal rearward portion interacts with the stopper portion 190 of the dual action follower 180.

As illustrated, the one or more cartridges 160 received by the magazine may be arranged in an offset or double stack configuration. In other optional embodiments, in order to minimize the general circumference and thus increase the ergonomics of the grip 114, the at least one cartridge 160 received by the magazine may be arranged in a single stack configuration.

As can best be seen in FIGS. 6-8, the magazine 116 may be a curved magazine. In such an embodiment, the additional cartridges of the at least one cartridge 160 positioned beneath the uppermost cartridge 162 may be more steeply angled within the magazine 116 relative to the uppermost cartridge 162. In other words, the angle of each cartridge positioned beneath the uppermost cartridge 162 may be less than or equal to the cartridge angle 150. This may allow the exterior depth 146 of the magazine 116 to be further minimized. In certain optional embodiments (not shown), the magazine 116 may be a straight magazine.

In certain optional embodiments, the steeper angling of the cartridges positioned beneath the uppermost cartridge may be accomplished due to the curvature of the magazine. In other optional embodiments (not shown), the steeper angling of the cartridges positioned beneath the uppermost cartridge may be accomplished by reducing the interior depth 144 of the magazine 116 so that those cartridges may be angled steeper than the uppermost cartridge 162. In such optional embodiment, at least the uppermost cartridge 162 may be maintained at the cartridge angle 150 while the lower cartridges are positioned steeper, having a larger angle than the cartridge angle 150. In some optional embodiments, the tip of the uppermost cartridge 162 may extend beyond a forward wall of the magazine 116. In order to maintain the uppermost cartridge 162 at the cartridge angle 150 while inserting the magazine 116 into the magazine passageway 132, a forward slot (not shown) may optionally be defined in the magazine passageway 132 for accommodating the tip of at least the uppermost cartridge 162.

In still other optional embodiments (not shown), the magazine 116 may be equipped with a mechanism that allows the one or more cartridges 160, including the uppermost cartridge 162, to be loaded into the magazine 116 at an angle steeper than the cartridge angle 150. The mechanism, once the magazine 116 is once fully inserted into the magazine passageway 132 of the grip 114, automatically releases the uppermost cartridge 162 so as to be aligned with the cartridge angle 150 as guided by the feed lips 142. Basically, the mechanism would cause the tail of each of the one or more cartridges 160 as they are inserted into the magazine 116 to be offset from the feed lips 142 to temporarily change the angle of the uppermost cartridge 162 prior to insertion into the magazine passageway of the grip.

Referring to FIGS. 9-14B, a further embodiment of a compact rifle-caliber firearm 200 is shown. Similar elements of the compact rifle-caliber firearm 200 are numbered similar to those of the compact rifle-caliber firearm 100. One of skill in the art will understand that certain details from the compact rifle-caliber firearm 200 are applicable to the compact rifle-caliber firearm 100, and likewise, certain details from the compact rifle-caliber firearm 100 are applicable to the compact rifle-caliber firearm 200. Differences between the compact rifle-caliber firearm 200 and the aforementioned compact rifle-caliber firearm 100 are now described. The compact rifle-caliber firearm 200 has similar advantages to those of the compact rifle-caliber firearm 100, namely, an improved center of gravity and the ability of the firearm to be easily holstered, as further described below and shown in FIGS. 21-23C.

Figure 1:
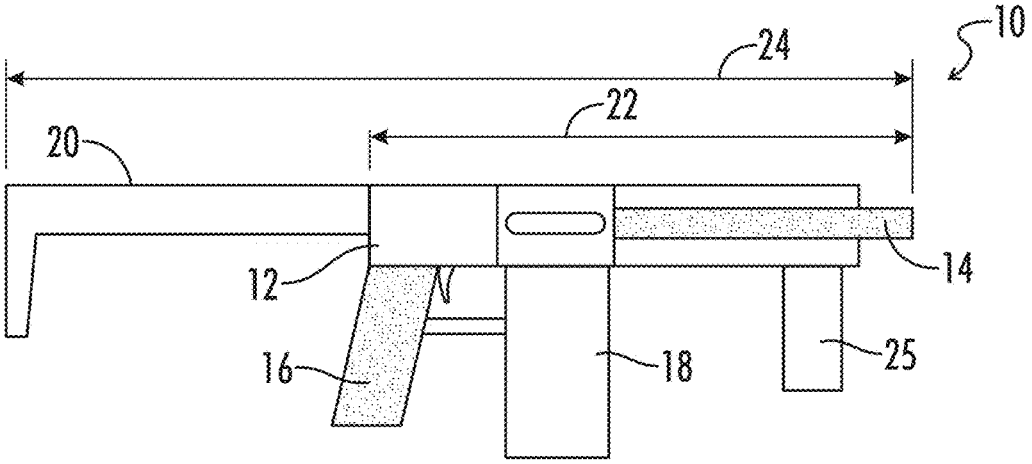
FIG. 1 (PRIOR ART)
FIG. 1 is a side elevation diagram of a firearm configured to receive a magazine forward of a grip of the firearm.
Figure 2:
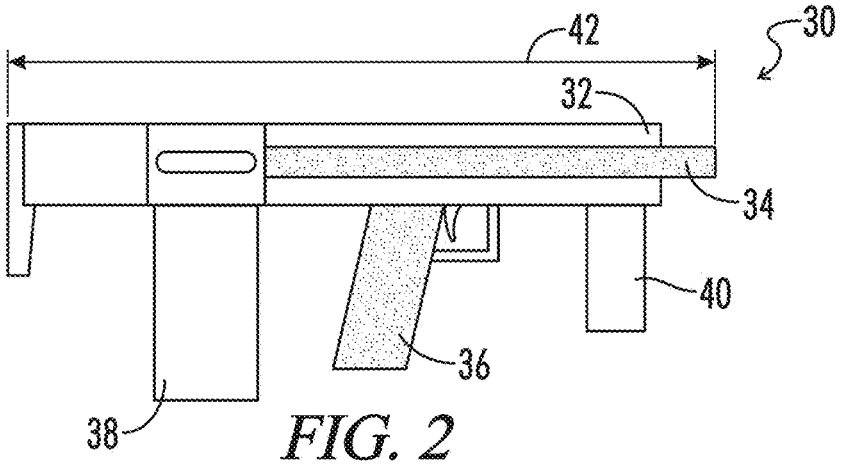
FIG. 2 (PRIOR ART)
FIG. 2 is a side elevation diagram of a firearm configured to receive a magazine rearward of the grip of the firearm.
Figure 3:
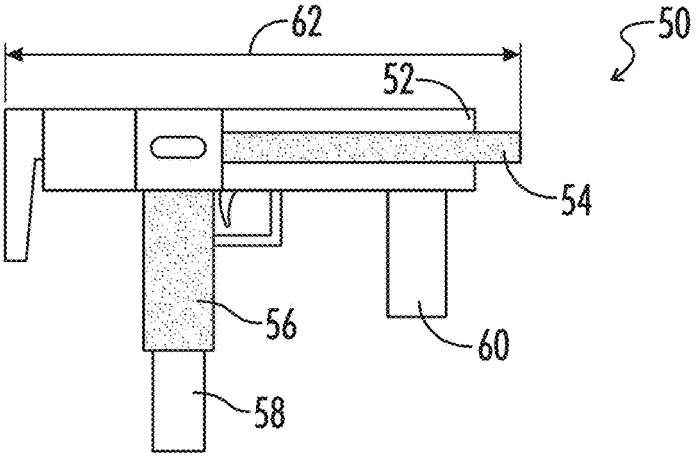
FIG. 3 (PRIOR ART)
FIG. 3 is a side elevation diagram of a firearm configured to receive a magazine within of a grip of the firearm.
Figure 4:
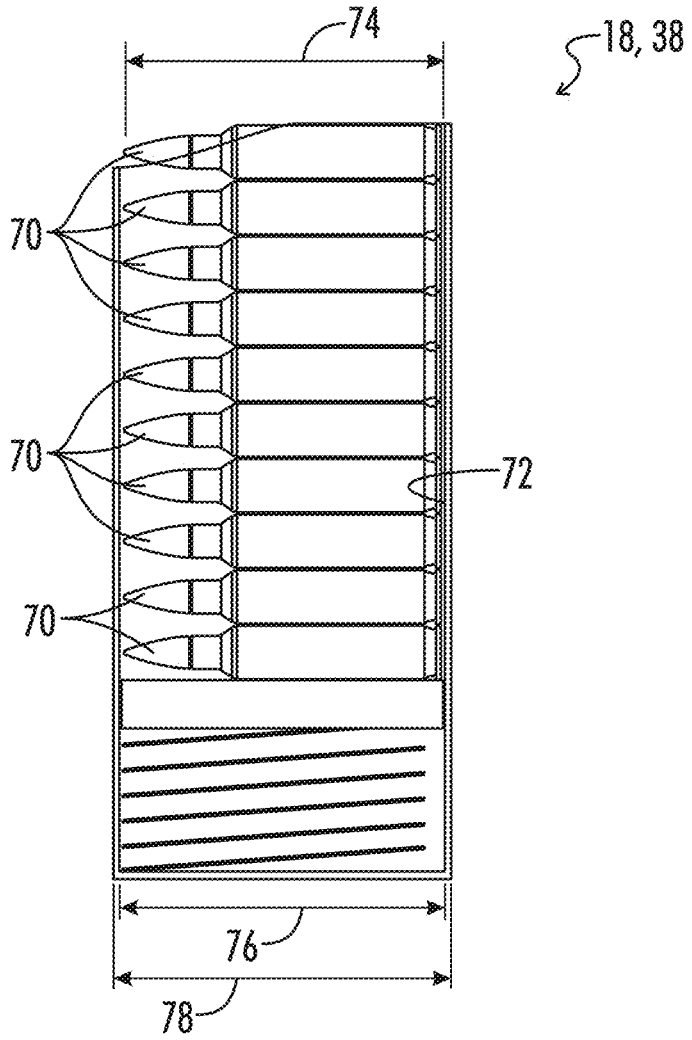
FIG. 4 (PRIOR ART)
FIG. 4 is a cross-sectional side elevation diagram of a magazine of the firearm of FIGS. 1 and 2.
Figure 5A:
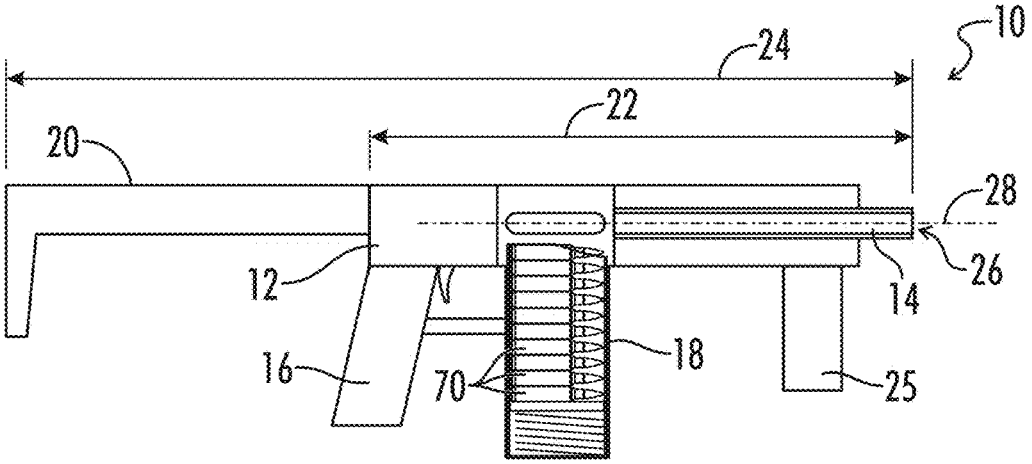
FIG. 5A (PRIOR ART)
FIG. 5A is a cross-sectional side elevation diagram of the firearm of FIG. 1.
Figure 5B:
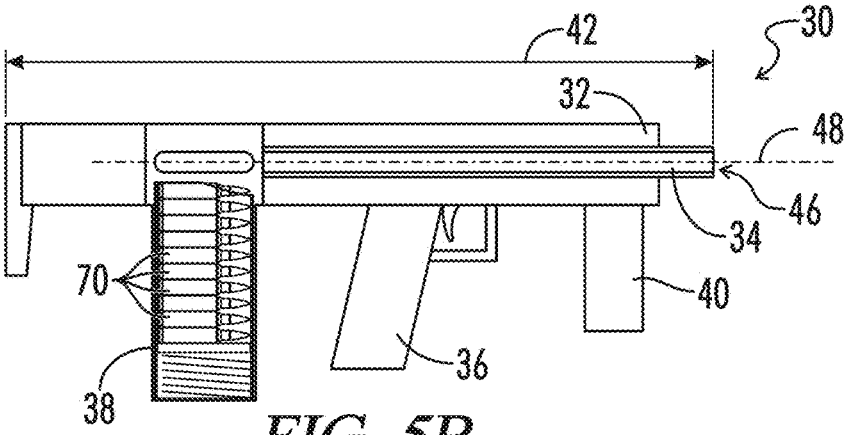
FIG. 5B (PRIOR ART)
FIG. 5B is a cross-sectional side elevation diagram of the firearm of FIG. 2.
Figure 5C:
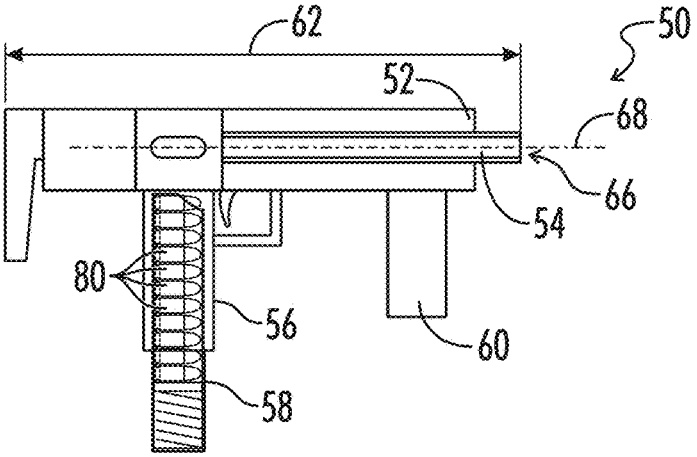
FIG. 5C (PRIOR ART)
FIG. 5C is a cross-sectional side elevation diagram of the firearm of FIG. 3.
Figure 15:
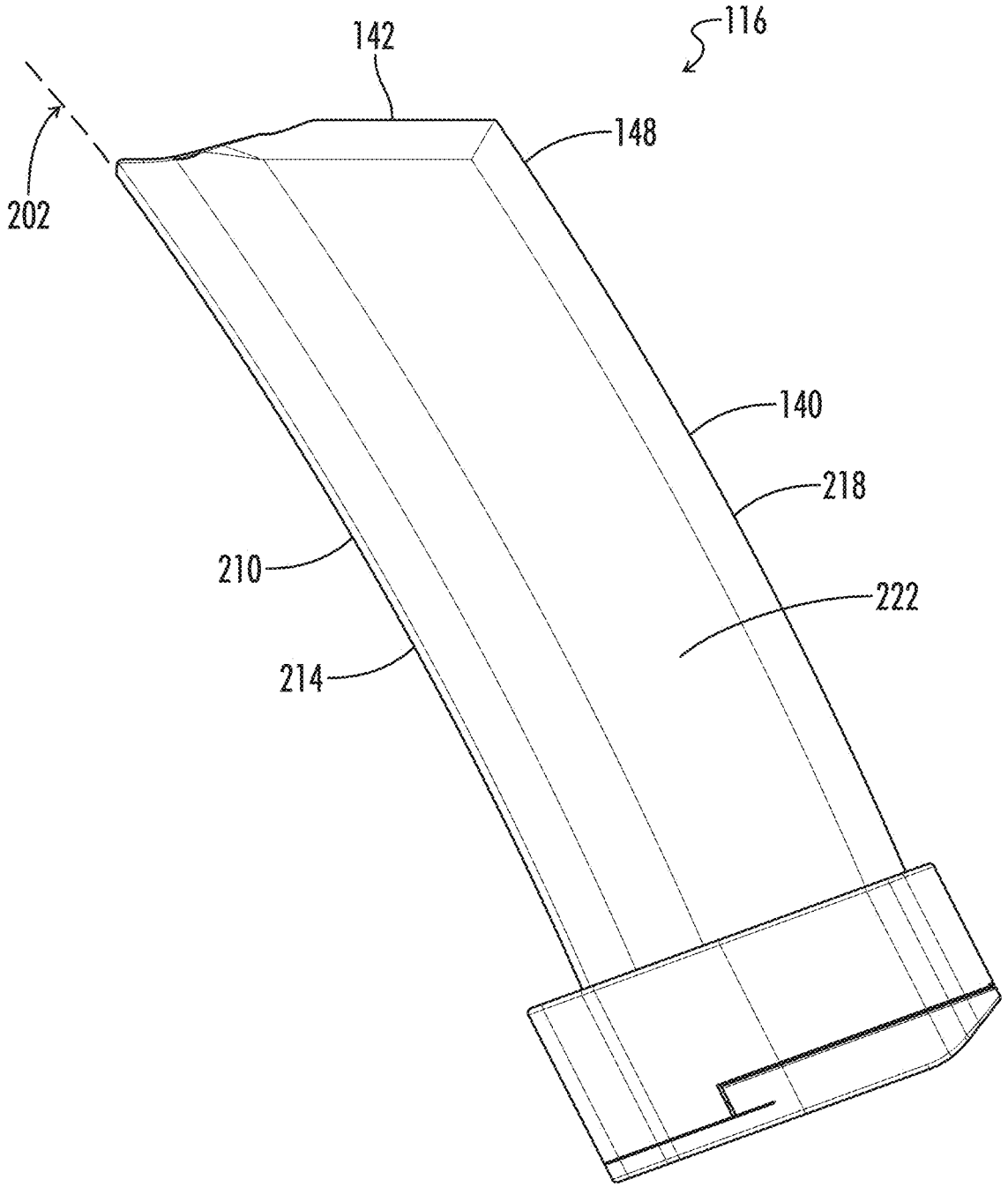
FIG. 15 is a left side elevation view of a magazine of the compact rifle-caliber firearm of FIG. 9 in accordance with the present disclosure.
Figure 18A:
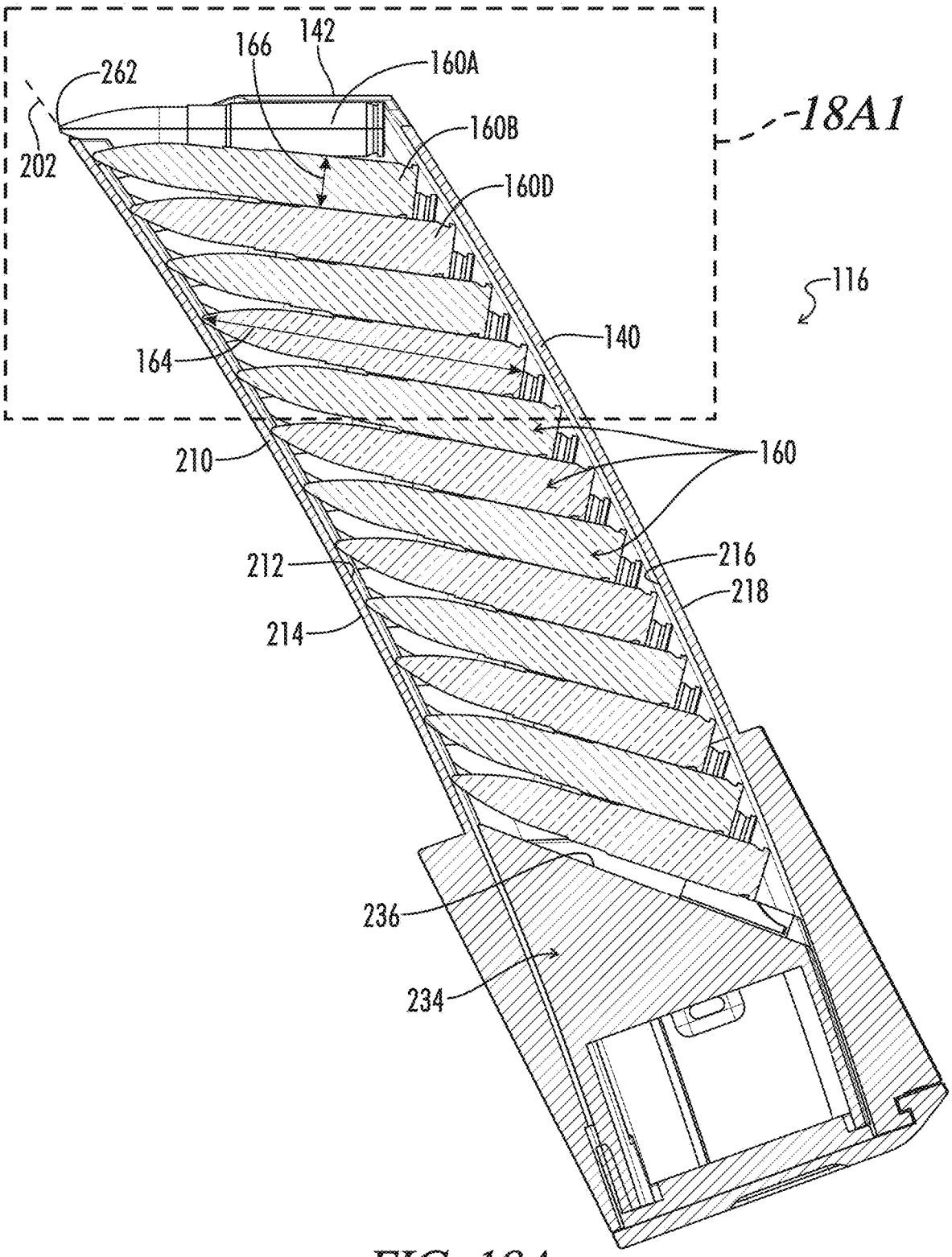
FIG. 18A is a cross-sectional left side elevation view of the magazine of FIG. 15 containing a plurality of cartridges in accordance with the present disclosure.
Figure 18B:
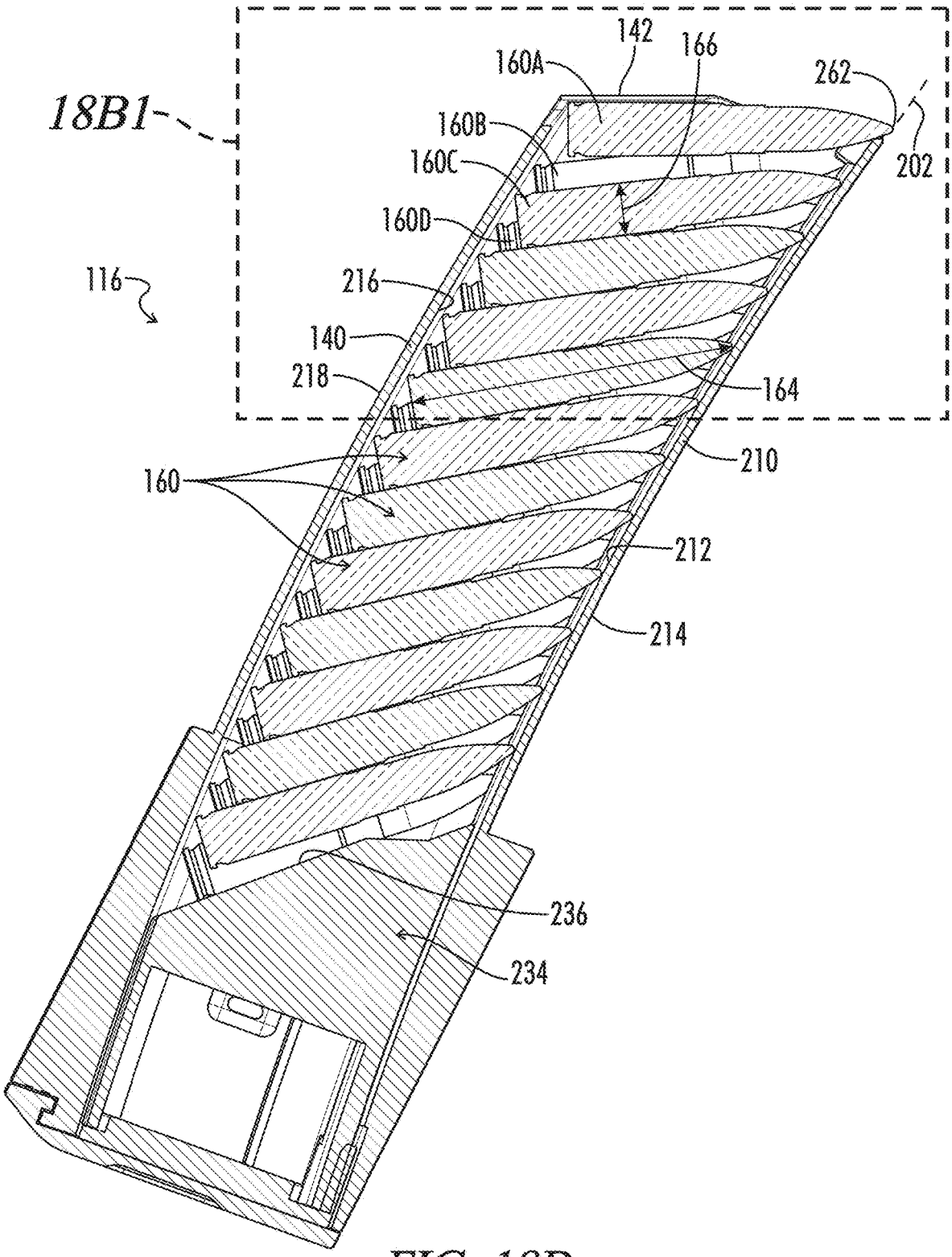
FIG. 18B is a cross-sectional right side elevation view of the magazine of FIG. 18A.

As can best be seen in FIGS. 15-18B1, the magazine 116 of the further embodiment of the compact rifle-caliber firearm 200 may be curved and be operable to receive a plurality of cartridges 160. The plurality of cartridges 160 may also be referred to herein as a plurality of rifle cartridges 160 or rifle cartridges 160. In other optional embodiments, the magazine 116 of the compact rifle-caliber firearm 200 may be straight or a combination of straight and curved portions.

The magazine 116 of the compact rifle-caliber firearm 200 may have a double stack configuration of the plurality of cartridges 160. As shown in FIGS. 18A and 18B, each cartridge of the plurality of cartridges 160 may be indicated based on its position relative to the feed lips 142 of the magazine 116. A first cartridge 160A may be the uppermost cartridge in contact with at least one of the feed lips 142. The first cartridge may also be referred to herein as an uppermost cartridge. A second cartridge 160B may be the closest cartridge to the feed lips 142 after the first cartridge 160A and be positioned adjacent to the first cartridge 160A. A third cartridge 160C and so on may be the next closest cartridge to the feed lip 142 after the first cartridge 160A and the second cartridge 160B while being adjacent to the last cartridge. The second, third, and so on cartridges may also be referred to herein as additional cartridges.

Figure 10:
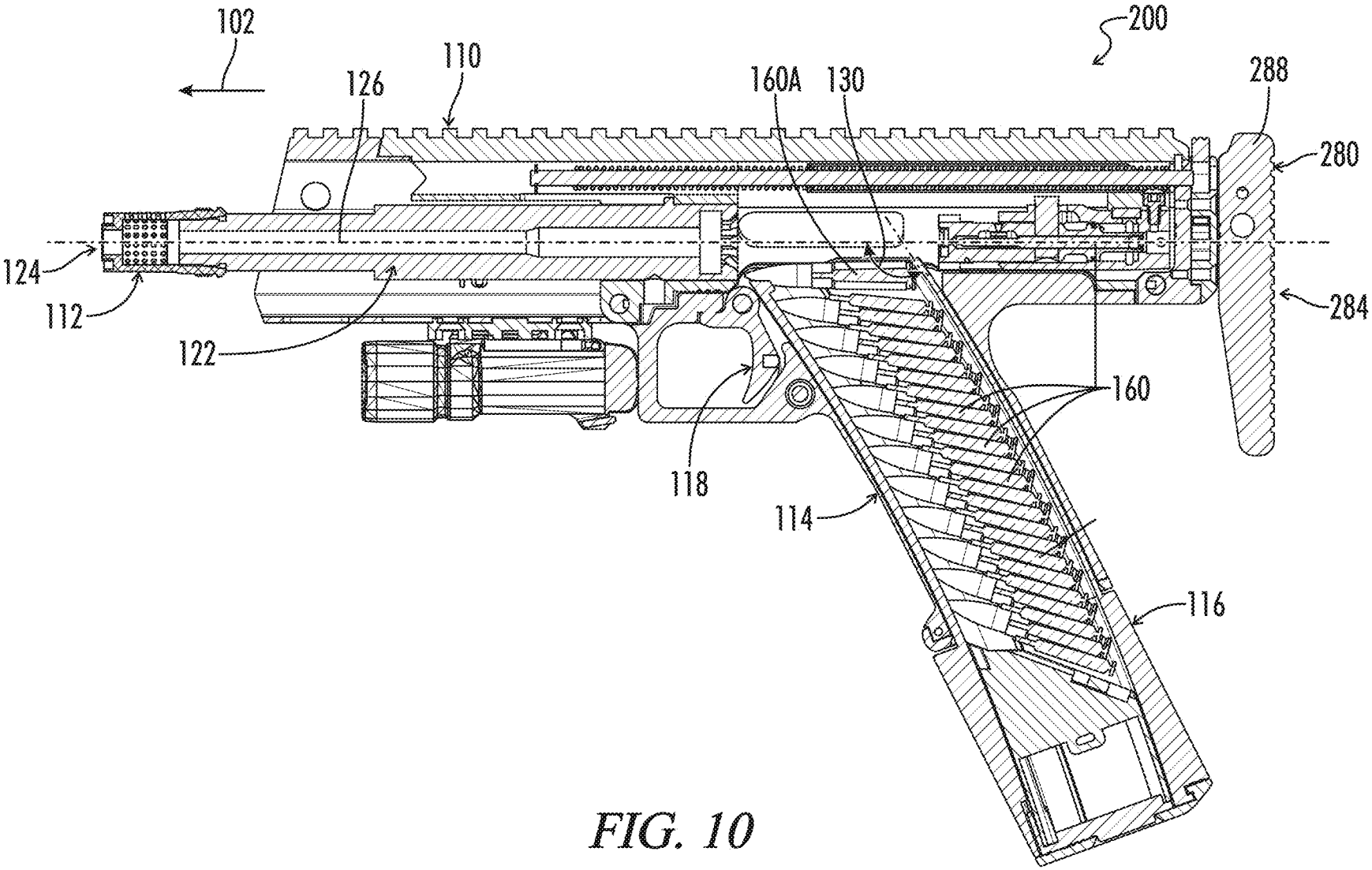
FIG. 10 is a cross-sectional left side elevation view of the compact rifle-caliber firearm of FIG. 9.
Figure 11:
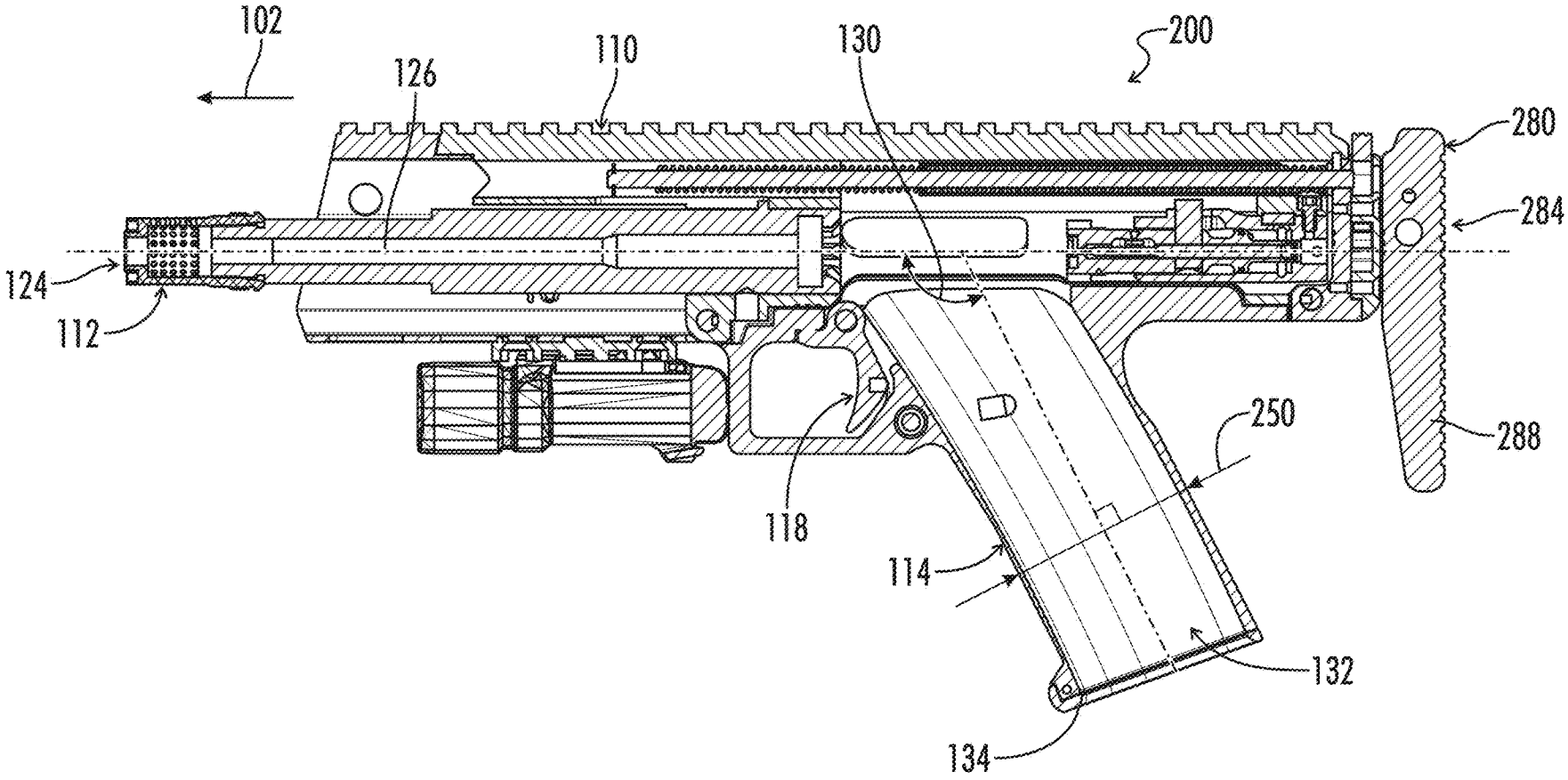
FIG. 11 is a cross-sectional left side elevation view of the compact rifle-caliber firearm of FIG. 10 with the magazine removed.
Figure 12:
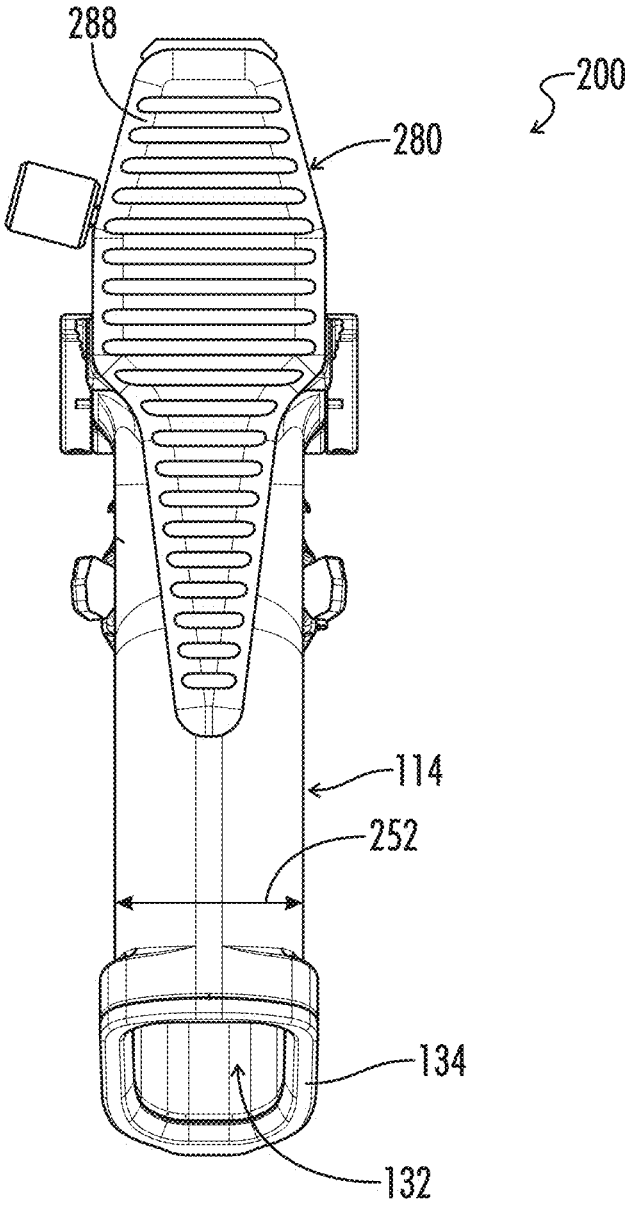
FIG. 12 is a rear elevation view of the compact rifle-caliber firearm of FIG. 9.

As can best be seen in FIG. 10, in some optional embodiments, the first cartridge 160A may be oriented about parallel to the bore axis 126 when the magazine 116 is received by the magazine passageway 132 of the grip 114. The orientation of the first cartridge 160A may be dictated by a feed lip angle 242 (shown in FIG. 16) relative to the upper portion 148 of the rearward wall 140. In such optional embodiments, the feed lip angle 242 may be about equal to the grip angle 130 such that the feed lips 142 are parallel to the bore axis 126. In other optional embodiments, an approximate plus or minus two (2) degree deviation may exist between the feed lips 142 and the bore axis 126.

The feed lip angle 242 relative to the upper portion 148 of the rearward wall 140 may be greater than or equal to one-hundred-ten (110) degrees and less than or equal to one-hundred-forty (140) degrees in certain embodiments. In some embodiments, the feed lip angle 242 may be greater than or equal to one-hundred-twenty (120) degrees and less than or equal to one-hundred-thirty 130 degrees. In certain other embodiments, the feed lip angle 242 may be greater than or equal to one-hundred-twenty-two 122 degrees and less than or equal to one-hundred-twenty-seven (127) degrees. The grip angle 130 may differ depending on the reference point at which the angle is measured, but is generally greater than or equal to about one-hundred-ten (110) degrees and less than or equal to about one-hundred-forty (140) degrees.

In other optional embodiments, the first cartridge 160A may have a first cartridge angle 260A relative to the upper portion 148 of the rearward wall 140. Accordingly, the first cartridge angle 260A may be about equal to the feed lip angle 242 of the feed lips 142 relative to the upper portion 148 of the rearward wall 140.

Additionally, and as can best be seen in FIGS. 18A-18B1, the first cartridge 160A may project beyond an interior forward wall surface 212 of a forward wall 210 of the magazine 116. In some optional embodiments, a distal tip 262 of the first cartridge 160A, positioned beyond the interior forward wall surface 212 of the forward wall 210 of the magazine 116, may be about aligned with an exterior forward wall surface 214 of the forward wall 210 of the magazine 116. In some optional embodiments, distal tip 262 of the first cartridge 160A may extend beyond the interior forward wall surface 212 of the forward wall 210 of the magazine 116 but not to the exterior forward wall surface 214 of the forward wall 210 of the magazine 116. In some optional embodiments, distal tip 262 of the first cartridge 160A may be about aligned with a tangent line 202 extending from an upper portion of the exterior forward wall surface 214 of the forward wall 210 of the magazine 116.

The rearward wall 140 of the magazine 116 of the compact rifle-caliber firearm 200 may include an interior rearward wall surface 216 and an exterior rearward wall surface 218. As used herein, the interior depth 144 of the magazine 116 is understood to mean a distance between the interior forward wall surface 212 and the interior rearward wall surface 216 defined perpendicularly to the interior rearward wall surface 216 at any point there along. Likewise, as used herein, the exterior depth 146 of the magazine 116 is understood to mean a distance between the exterior forward wall surface 214 and the exterior rearward wall surface 218 defined perpendicularly to the exterior rearward wall surface 218 at any point there along. The direction of the interior depth 144 and the direction of the exterior depth 146 may be parallel at any given point along the rearward wall 140.

As can best be seen in FIGS. 10, 18A-18B1, the second, third, and so on cartridges 160B, 160C may be angled relative to the first cartridge 160A and the feed lips 142. In such an optional embodiment, the feed lip angle 242 may be less than a summation of ninety (90) degrees plus a sinusoidal function of the interior depth 144 divided by the cartridge length 164. Namely, the sinusoidal function may be an arc cosine. In another optional embodiment, the second, third, and so on cartridges 160B, 160C may be angled relative to the first cartridge 160A due to the interior depth 144 of the magazine 116 being less than the cartridge length 164. In certain optional embodiments, the interior depth 144 of the magazine 116 may be less than about 57 millimeters. In other optional embodiments, the interior depth 144 of the magazine 116 may be less than about 50 millimeters. In certain optional embodiments, the interior depth 144 of the magazine 116 may be less than about 47 millimeters. In other optional embodiments, the second, third, and so on cartridge angles 260B, 260C may be greater than or equal to a sinusoidal function of at least the interior depth 144 divided by the cartridge length 164. Namely, the sinusoidal function may be an arc cosine. The magazine 116 may thus be operable to position the second cartridge 160B and so forth angled relative to the first cartridge 160A.

In certain optional embodiments, at least a portion of the exterior depth 146 of the magazine 116 may be less than or equal to the cartridge length 164 or about 57 millimeters. In some optional embodiments, the exterior depth 146 along a majority of a grip length of the magazine may be less than the cartridge length 164. In other optional embodiments, at least a portion of the exterior depth 146 may be less than or equal to 52 millimeters. In still other optional embodiments, the exterior depth 146 of the magazine 116 may be greater than the cartridge length 164. In further optional embodiments, the exterior depth 146 along a majority of a grip length of the magazine may be greater than the cartridge length 164.

Figure 16:
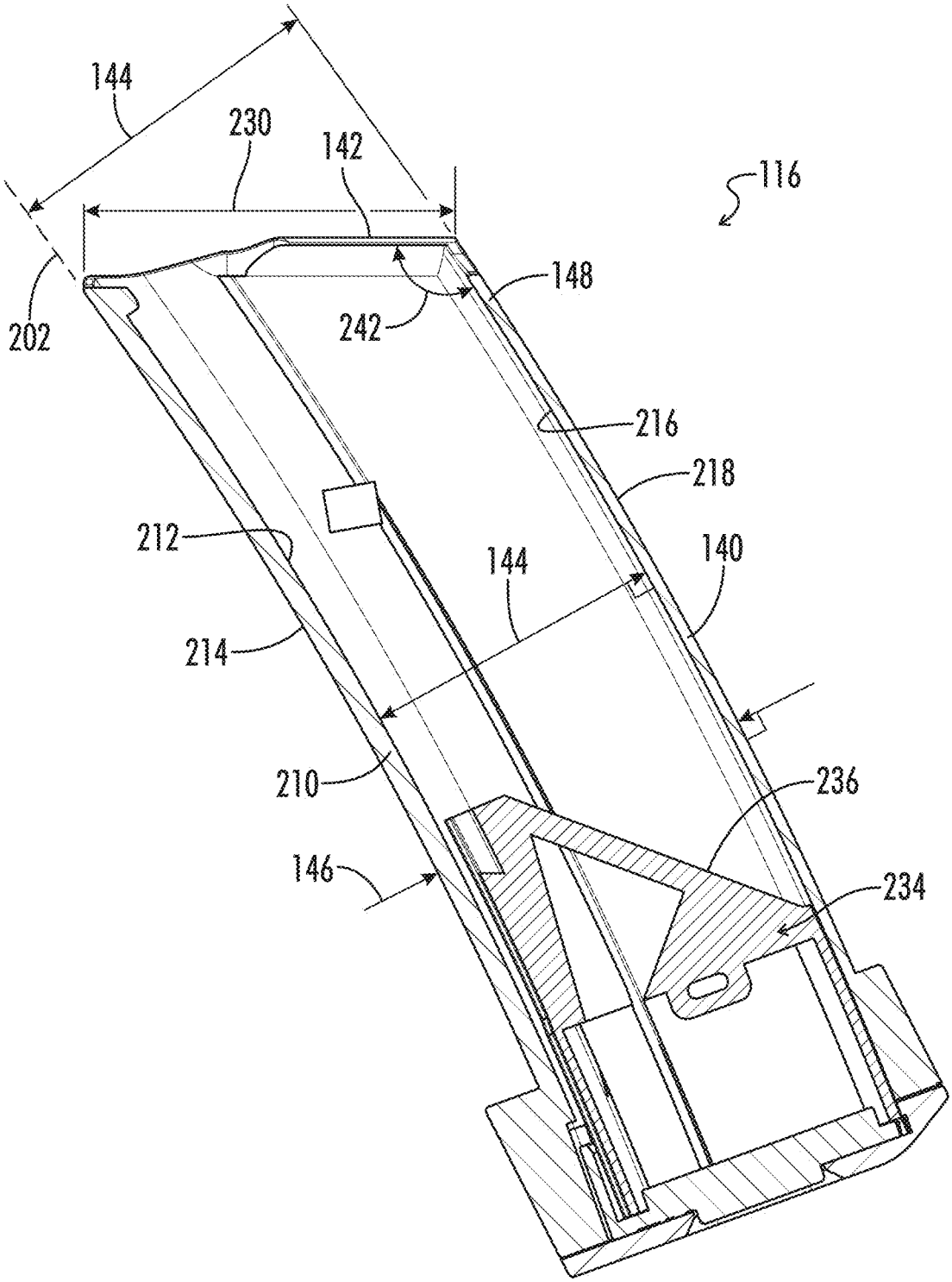
FIG. 16 is a cross-sectional left side elevation view of the magazine of FIG. 15.

In optional embodiments, as shown in FIG. 16, an angled exterior depth 230 of the magazine 116 may be defined parallel to the feed lips 142. The angled exterior depth 230 may be less than or equal to the cartridge length 164. In some optional embodiments, the angled exterior depth 230 may be greater than 50 millimeters. In other optional embodiments, the angled exterior depth 230 may be greater than the cartridge length 164.

As can best be seen in FIGS. 18A and 18A1, the second cartridge may be arranged at a second cartridge angle 260B relative to rearward wall 140 of the magazine 116. In some optional embodiments, the second cartridge angle 260B may be greater than the first cartridge angle 260A by about one-half (0.5) of a degree. In other optional embodiments, the second cartridge angle 260B may be greater than the first cartridge angle 260A by about one (1) degree. In some optional embodiments, the second cartridge angle 260B may be greater than the first cartridge angle 260A by about ten (10) degrees. In an optional embodiment, the second cartridge angle 260B may be greater than the first cartridge angle 260A by about six-point-five (6.5) degrees.

Accordingly, the magazine 116 is operable to position the second cartridge 160B angled from about one-half (0.5) of a degree to about ten (10) degrees relative to the first cartridge 160A or the feed lips 142. In other embodiments, the magazine 116 is operable to position the second cartridge 160B angled from about three (3) degrees to about eight (8) degrees relative to the first cartridge 160A or the feed lips 142. In still further embodiments, the magazine 116 is operable to position the second cartridge 160B angled from about six (6) degrees to about seven (7) degrees relative to the first cartridge 160A or the feed lips 142. In various other optional embodiments, the plurality of cartridges 160 received by the magazine 116 may be parallel as shown in FIG. 6.

As can best be seen in FIG. 18B1, the third cartridge 160C may be angled at a third cartridge angle 260C relative to the upper portion 148 of the rearward wall 140. The third cartridge angle 260C may be greater than the first cartridge angle 260A by about one (1) degree in optional embodiments. In some optional embodiments, the third cartridge angle 260C may be greater than the first cartridge angle 260A by about one-point-five (1.5) degrees. In other optional embodiments, the third cartridge angle 260C may be greater than the first cartridge angle 260A by about eleven (11) degrees. In an optional embodiment, the third cartridge angle 260C is about seven (7) degrees greater than the first cartridge angle 260A. In various optional embodiments, the third cartridge angle 260C may be greater than the second cartridge angle 260B of second cartridge 160B. In optional embodiments, the third cartridge angle 260C is different than the second cartridge angle 260B of second cartridge 160B and the first cartridge angle 260A of first cartridge 160A.

Accordingly, the magazine 116 is operable to position the third cartridge 160C angled from about one (1) degree to about eleven (11) degrees relative to the first cartridge 160A or the feed lips 142. In other embodiments, the magazine 116 is operable to position the third cartridge 160C angled from about four (4) degrees to about nine (9) degrees relative to the first cartridge 160A or the feed lips 142. In still further embodiments, the magazine 116 is operable to position the third cartridge 160C angled from about six-point-five (6.5) degrees to about eight (8) degrees relative to the first cartridge 160A or the feed lips 142.

In optional embodiments, one or more successive cartridge of the plurality of cartridges 160 may have a cartridge angle greater than that of the previous cartridge. In other optional embodiments, one or more successive cartridge of the plurality of cartridges 160 may have a cartridge angle less than or equal to two (2) degrees greater than the previous cartridge angle. In still other optional embodiments, one or more successive cartridge of the plurality of cartridges 160 may have a cartridge angle approximately one-half (0.5) of a degree greater than the previous cartridge angle. Accordingly, the fourth cartridge 160D may have a fourth cartridge angle 260D greater than about seven (7) degrees or approximately seven-point-five (7.5) degrees, and so forth for each successive cartridge.

As can best be seen in FIGS. 16, 18A, and 18B, the magazine 116 may further include a follower 234 with a primary surface 236 angled relative to the interior rearward wall surface 216 above the follower 234. In some embodiments, the primary surface 236 may be angled from about ten (10) degrees to about sixty (60) degrees relative to the interior rearward wall surface 216 when the follower 234 is adjacent to cartridges 160 of the magazine 116. In certain embodiments, the primary surface 236 may be angled from about twenty-five (25) degrees to about fifty (50) degrees relative to the interior rearward wall surface 216. In still other embodiments, primary surface 236 may be angled from about thirty-five (35) degrees to about forty-five (45) degrees relative to the interior rearward wall surface 216.

Figure 17:
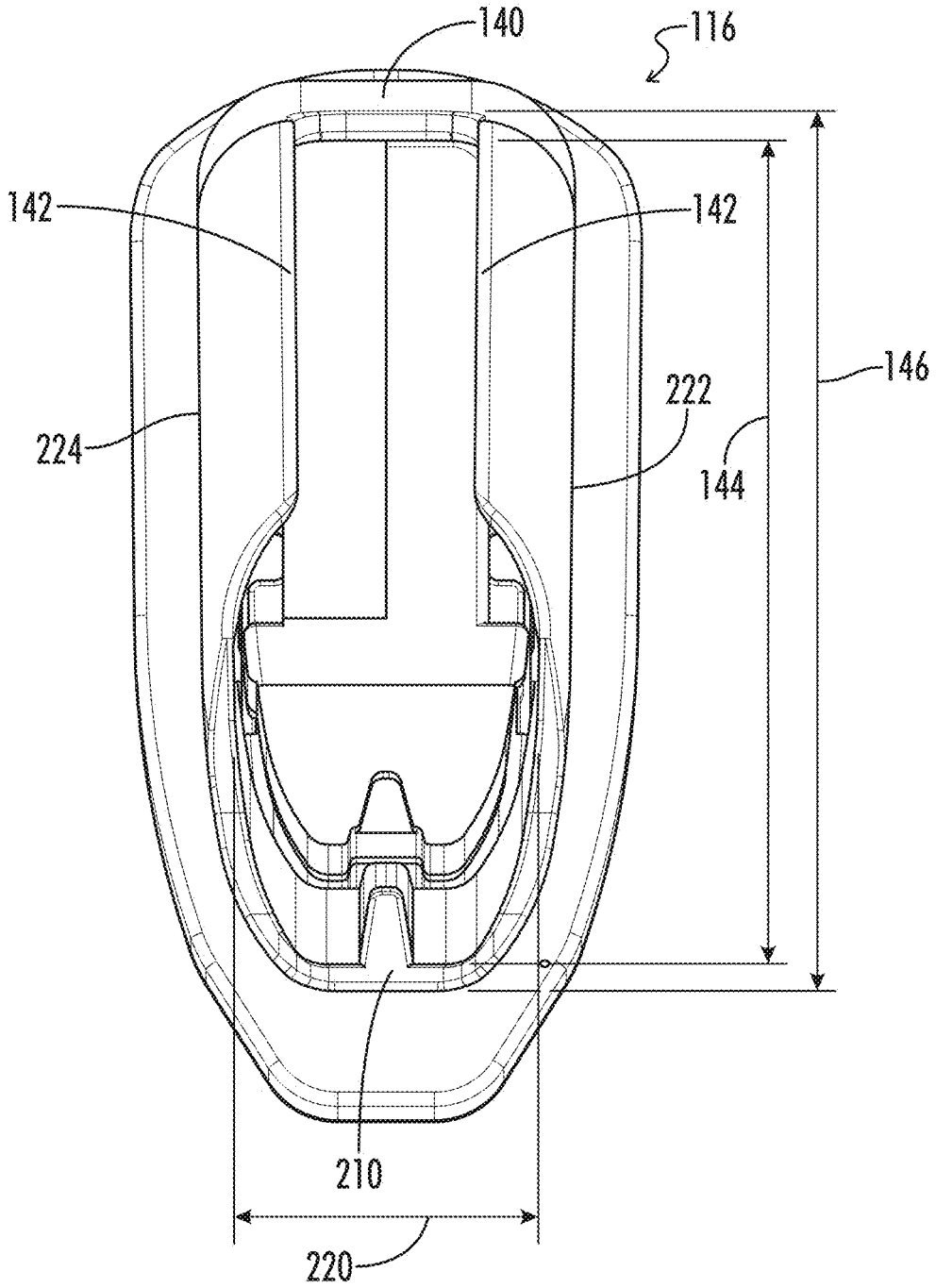
FIG. 17 is a top plan view of the magazine of FIG. 15.

In other optional embodiments, as can best be seen in FIG. 17, the magazine 116 of the compact rifle-caliber firearm 200 includes an interior width 220 defined between first and second sidewalls 222, 224, respectively, of the magazine 116. The interior width 220 is further defined perpendicularly to the interior depth 144 and the exterior depth 146. In optional embodiments, the interior width 220 may be greater than the cartridge diameter 166. In other optional embodiments, the interior width 220 may be less than two-times (2×) the cartridge diameter 166. For a double stack configuration of the plurality of cartridges 160, the interior width 220 is closer to two-times (2×) the cartridge diameter 166 than to one-times (1×) the cartridge diameter 166. For a single stack configuration of the plurality of cartridges 160, the interior width 220 is closer to one-times (1×) the cartridge diameter 166 than to two-times (2×) the cartridge diameter 166. In certain embodiments, the cartridge diameter 166 may be greater than or equal to 9.5 mm.

As can best be seen in FIGS. 10, 11, 13, 14A, and 14B, the grip 114 of the compact rifle-caliber firearm 200 extends below and is angled rearwardly relative to the bore axis 126 as the grip angle 130. In certain optional embodiments, the grip 114 includes a grip depth 250 and a grip width 252. The grip depth 250 may be defined parallel to the interior and exterior depths 144, 146, of the magazine 116 when received by the magazine passageway 132 of the grip 114. The grip depth 250 may further be defined perpendicularly to the grip angle 130 relative to the bore axis 126. The grip width 252 may be defined parallel to the interior width 220 of the magazine 116 when received by the magazine passageway 132 of the grip 114. The grip width 252 may be defined perpendicularly to the grip depth 250. In optional embodiments, the grip depth 250 may be greater than or equal to two (2) inches. In other optional embodiments, the grip depth 250 may be grater than or equal to one-point-five (1.5) inches. In still further optional embodiments, the grip depth 250 may be less than or equal to the cartridge length 164. In other embodiments, the grip depth 250 may be less than or equal to 80 mm. In some optional embodiments, the grip width 252 may be greater than the cartridge diameter 166. In other optional embodiments, the grip width 252 may be less than or equal to three-times (3×) the cartridge diameter 166. In other optional embodiments, the grip width 252 may be greater than or equal to 25 millimeters and less than or equal to 35 millimeters. In other optional embodiments, the grip width 252 may be less than or equal to 30 millimeters. In certain embodiments, the cartridge length 164 may be greater than or equal to 57 mm.

Figure 14A:
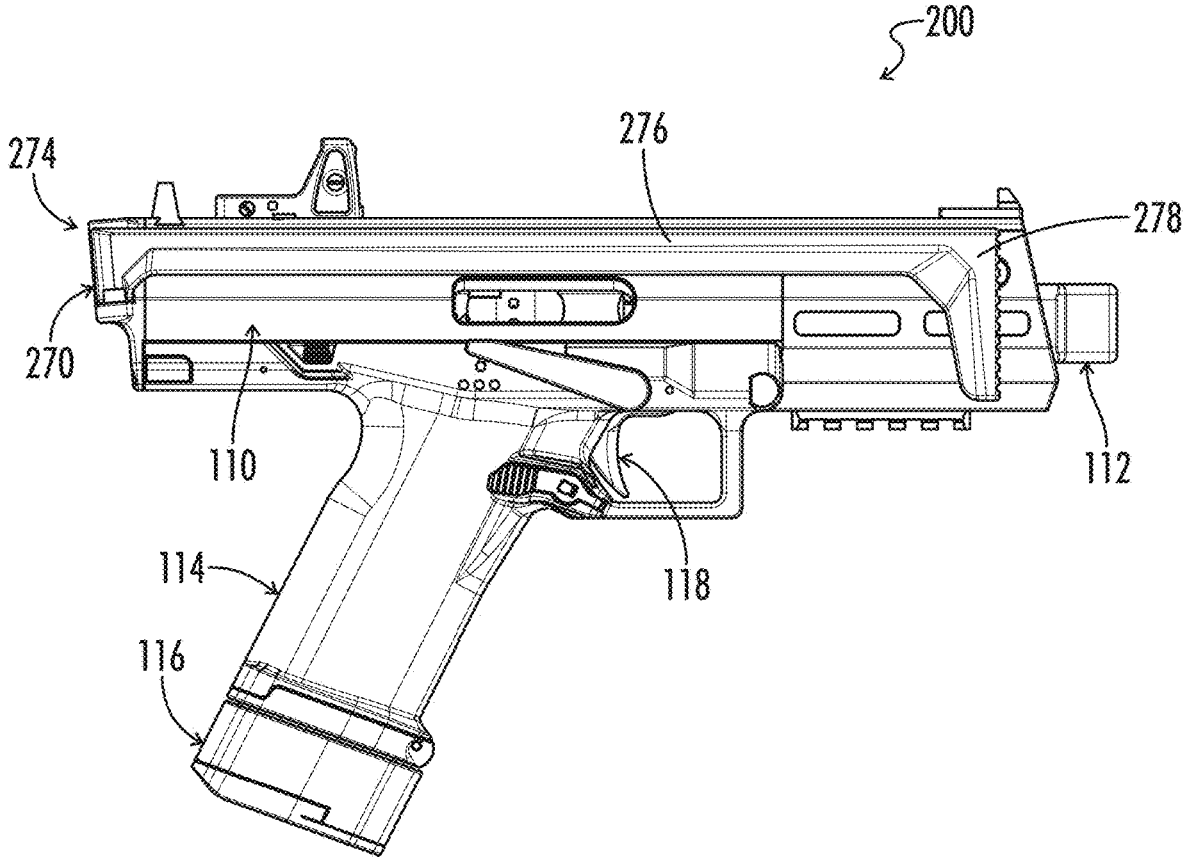
FIG. 14A is a right side elevation view of the compact rifle-caliber firearm of FIG. 9 with a pivotal stock in a retracted position.
Figure 14B:
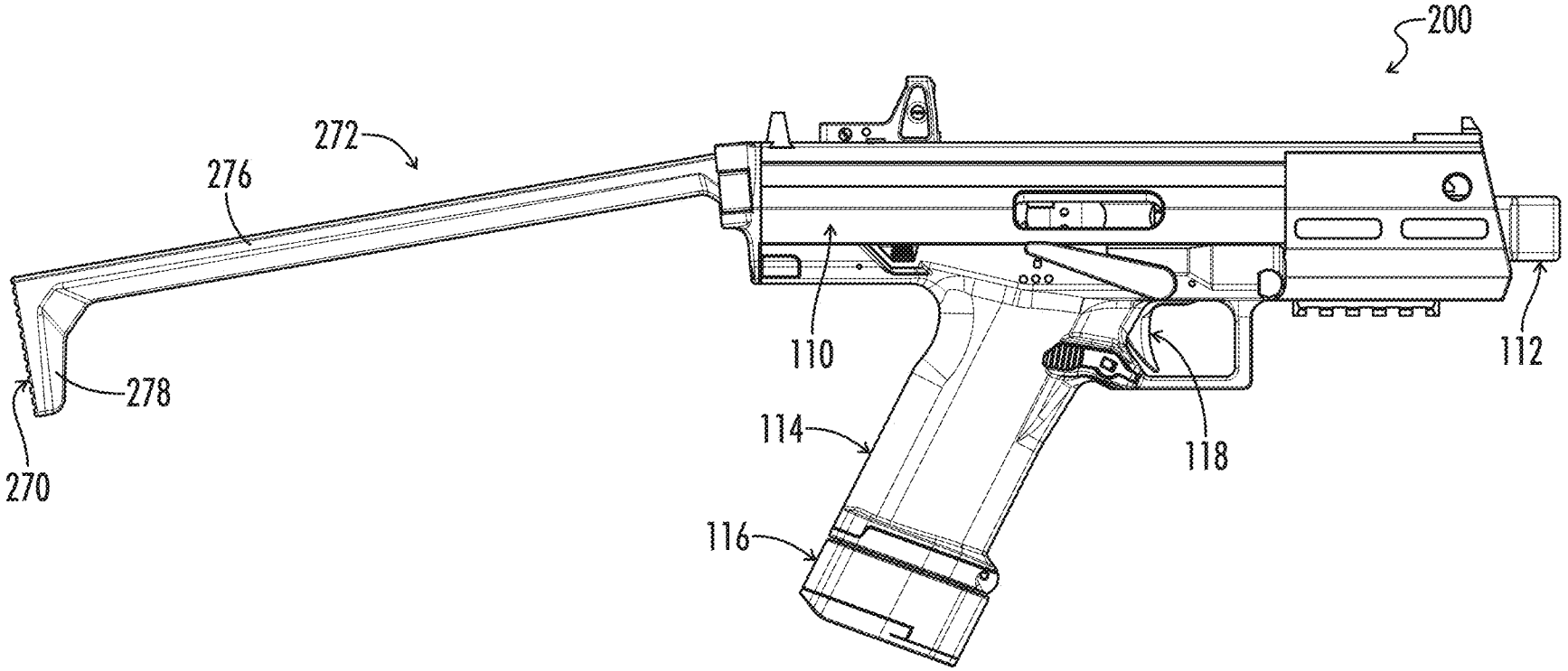
FIG. 14B is a right side elevation view of the compact rifle-caliber firearm of FIG. 14A with the retractable stock in an extended position.

In optional embodiments, the compact rifle-caliber firearm 200 may include a pivotal stock 270, as shown in FIGS. 14A and 14B. The pivotal stock 270 may be hingedly coupled to a rear end of the receiver body 110 of the compact rifle-caliber firearm 200, opposite the forward direction 102 in which the barrel 112 extends. The pivotal stock 270 may be configured in an extended position 272 or a retracted position 274 and may include an arm 276 and a butt 278. As illustrated in FIG. 14A, the arm 276 of the pivotal stock 270, when in the retracted position 274, is positioned adjacent to the receiver body 110 above an ejection port of the receiver body 110 with the butt 278 nearer to the front end of the receiver body 110 than to the rear end. As illustrated in FIG. 14B, the arm 276 of the pivotal stock 270, when in the extended position 272, extends away from the rear end of the receiver body 110 with the butt 278 positioned distally thereto for supporting a shoulder of the user during use of the compact rifle-caliber firearm 200. It should be noted that the compact rifle-caliber firearm 200 may be utilized with the pivotal stock 270 in either the extended positioned 272 or the retracted position 274. Additionally, in optional embodiments, the butt 278 may be configured to be used as a forward handle by the user when the pivotal stock 270 is in the retracted positioned 274.

Figure 13:
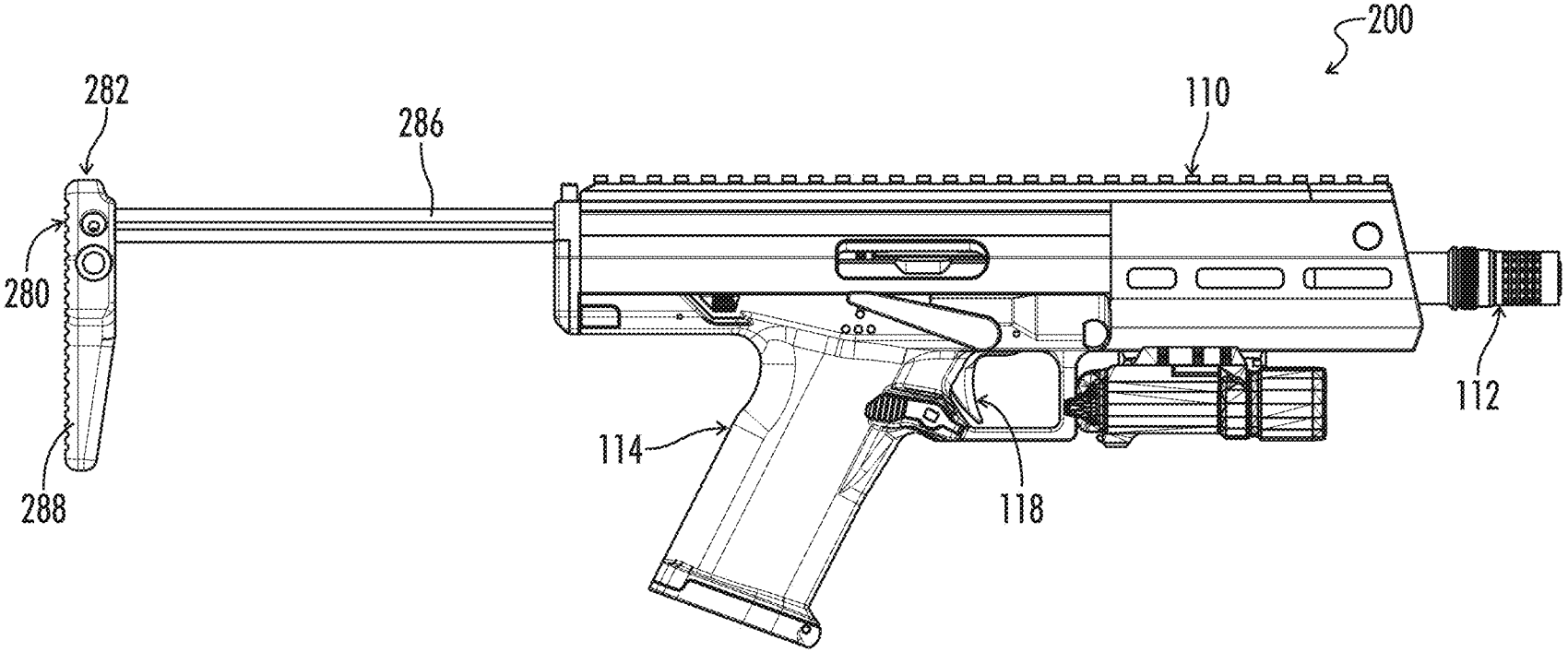
FIG. 13 is a right side elevation view of the compact rifle-caliber firearm of FIG. 9 with a retractable stock in an extended position.

Alternatively, the compact rifle-caliber firearm 200 may include a retractable stock 280, as shown in FIGS. 9-13. The retractable stock may be configured in an extended position 282 or a retracted position 284 and may include a pair of arms 286 and a butt 288. As illustrated in FIG. 9-12, the pair of arms 286 of the retractable stock 280, when in the retracted position 284, are slidably received by and positioned adjacent to opposite sides of the receiver body 110 with the butt 288 positioned adjacent to the rear end of the receiver body 110. As illustrated, one of the pair of arms 286 may be above an ejection port of the receiver body 110 when in the retracted position 284, with the other arm positioned at a similar elevation along an opposite side of the receiver body 110. As illustrated in FIG. 13, the pair of arms 286 of the retractable stock 280, when in the extended position 282, slidably extend away from the rear end of the receiver body 110 with the butt 288 positioned distally thereto for bracing against a shoulder of the user during use of the compact rifle-caliber firearm 200, when so chosen. It should likewise be noted that the compact rifle-caliber firearm 200 may be utilized with the retractable stock 280 in either the extended positioned 282 or the retracted position 284.

Figure 19A:
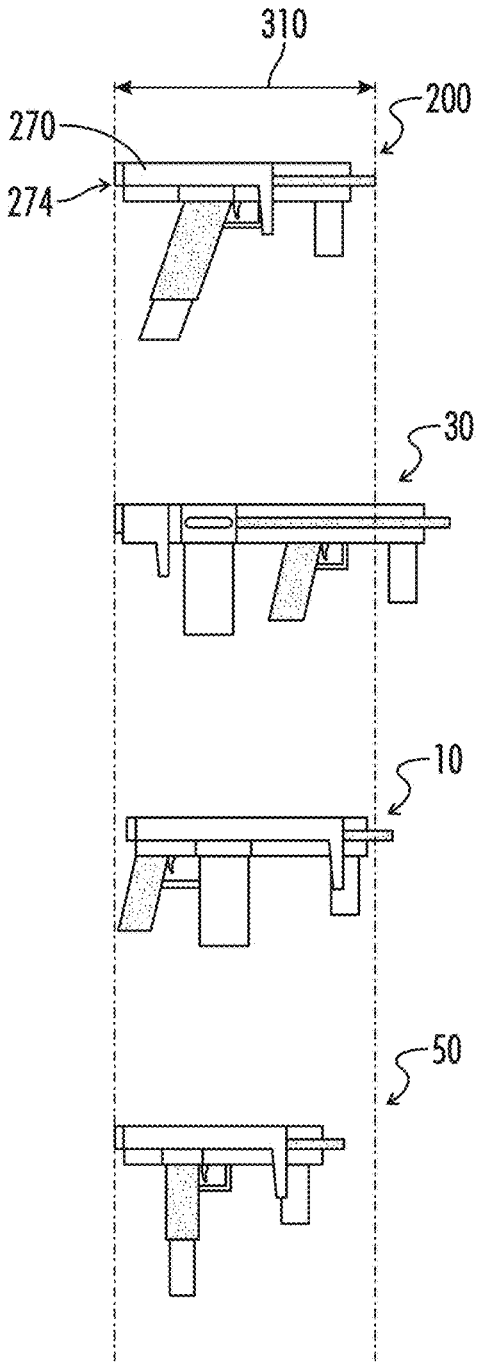
FIG. 19A is a comparison of the lengths of the compact rifle-caliber firearm of FIG. 9, the forward-fed firearm of FIG. 1, the rearward-fed firearm of FIG. 2, and the grip-fed firearm of FIG. 3, each including a pivotal stock configured in a retracted position.
Figure 19B:
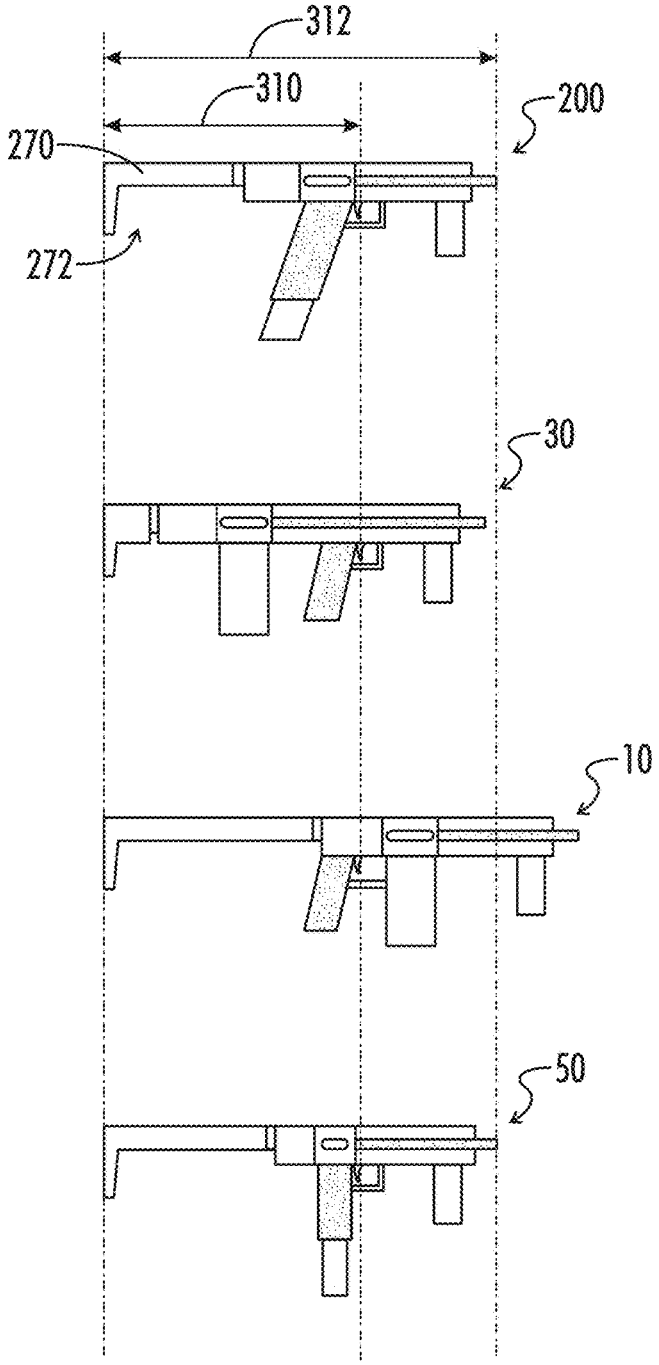
FIG. 19B is a comparison of the lengths of the compact rifle-caliber firearm of FIG. 9, the forward-fed firearm of FIG. 1, the rearward-fed firearm of FIG. 2, and the grip-fed firearm of FIG. 3, with the pivotal stock configured in an extended position

Referring FIGS. 19A and 19B, a comparison of the lengths of the compact rifle-caliber firearm 200, the forward-fed firearm 10, the rearward-fed firearm 30, and the grip-fed firearm 50, all including pivotal stocks, is shown. A pivotal retracted length 310 of the compact rifle-caliber firearm 200 with the pivotal stock 270 in the retracted position 274 is shown in FIG. 19A. As illustrated, the pivotal retracted length 310 of the compact rifle-caliber firearm 200 is shorter than the lengths of each of the forward-fed firearm 10, the rearward-fed firearm 30, and the grip-fed firearm 50, each including a pivotal stock configured in a retracted position. A pivotal extended length 312 of the compact rifle-caliber firearm 200 with the pivotal stock 270 in the extended position 272 is shown in FIG. 19B. As illustrated, the pivotal extended length 312 of the compact rifle-caliber firearm 200 is shorter than the lengths of each of the forward-fed firearm 10, the rearward-fed firearm 30, and the grip-fed firearm 50, each including a pivotal stock configured in an extended position.

Figure 20A:
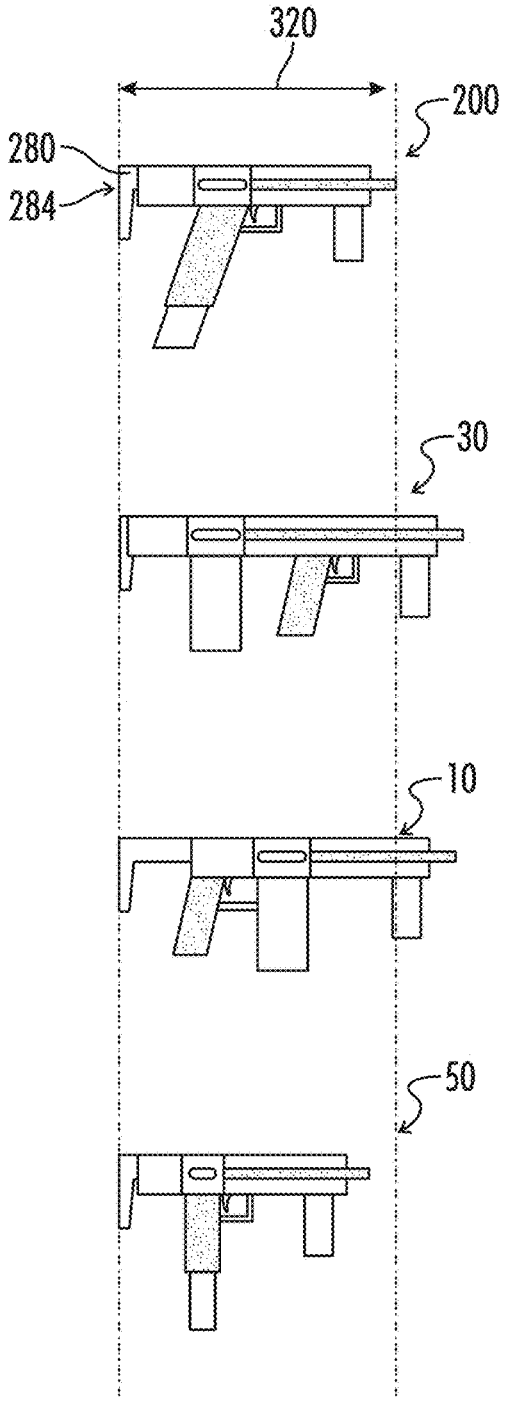
FIG. 20A is a comparison of the lengths of the compact rifle-caliber firearm of FIG. 9, the forward-fed firearm of FIG. 1, the rearward-fed firearm of FIG. 2, and the grip-fed firearm of FIG. 3, each including a telescoping stock configured in a retracted position.
Figure 20B:
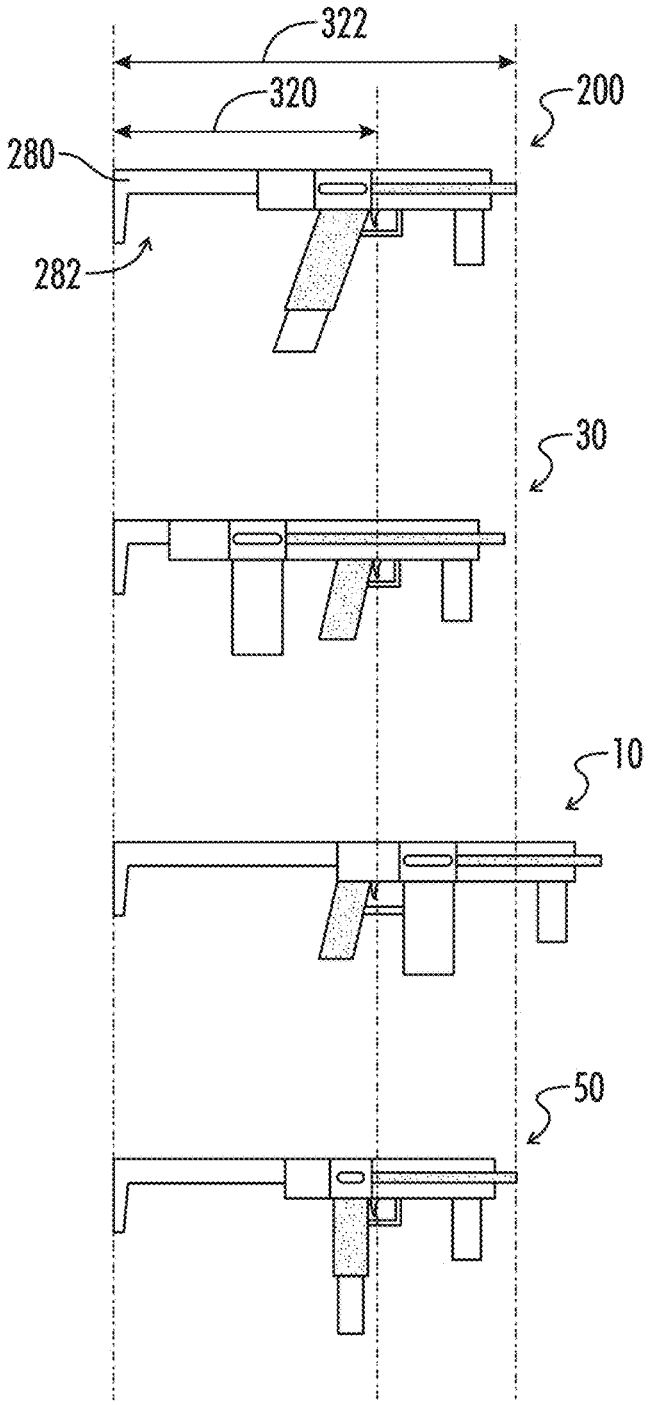
FIG. 20B is a comparison of the lengths of the compact rifle-caliber firearm of FIG. 9, the forward-fed firearm of FIG. 1, the rearward-fed firearm of FIG. 2, and the grip-fed firearm of FIG. 3, with the telescoping stock configured in an extended position.

Referring FIGS. 20A and 20B, a comparison of the lengths of the compact rifle-caliber firearm 200, the forward-fed firearm 10, the rearward-fed firearm 30, and the grip-fed firearm 50, all including retractable stocks, is shown. A retractable retracted length 320 of the compact rifle-caliber firearm 200 with the retractable stock 280 in the retracted position 284 is shown in FIG. 20A. As illustrated, the retractable retracted length 320 of the compact rifle-caliber firearm 200 is shorter than the lengths of each of the forward-fed firearm 10, the rearward-fed firearm 30, and the grip-fed firearm 50, each including a retractable stock configured in a retracted position. A retractable extended length 322 of the compact rifle-caliber firearm 200 with the retractable stock 280 in the extended position 282 is shown in FIG. 20B. As illustrated, the retractable extended length 322 of the compact rifle-caliber firearm 200 is shorter than the lengths of each of the forward-fed firearm 10, the rearward-fed firearm 30, and the grip-fed firearm 50, each including a retractable stock configured in an extended position.

Referring to FIG. 21, a comparison of the position of balance points (or center of gravity/mass) for the compact rifle-caliber firearm 200, the forward-fed firearm 10, the rearward-fed firearm 30, and a pistol 90 is shown. The pistol 90 is designed for single hand usage and as such a pistol balance point 92 is positioned directly above the handle and trigger of the pistol 90. Similar to the pistol 90, the compact rifle-caliber firearm 200 includes a balance point 330 positioned directly above the grip 114 and the trigger 118. The balance point 330 allows the compact rifle-caliber firearm 200 to be easily operated with a single hand while maintaining alignment of the bore axis 126 with a horizontal plane 332. As illustrated in FIG. 21, the rearward-fed firearm 30 includes a rearward balance point 44 positioned rearward of the handle 36. The position of the rearward balance point 44 requires the rearward-fed firearm 30 to be operated with two hands in order to maintain accuracy (i.e., to keep the barrel 34 aligned with the horizontal plane 332) because when operated with a single hand, the barrel is raised above the horizontal plane 332. As further illustrated in FIG. 21, the forward-fed firearm 10 includes a forward balance point 27 positioned forward of the handle 16. The position of the forward balance point 27 requires the forward-fed firearm 10 to be operated with two hands in order to maintain accuracy (i.e., to keep the barrel 14 aligned with the horizontal plane 332) because when operated with a single hand the barrel drops below the horizontal plane 332.

Figure 23A:
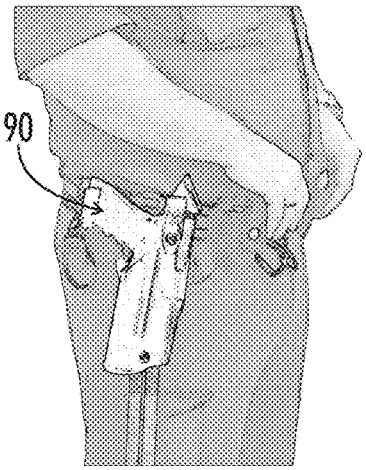
FIG. 23A is a perspective view of the pistol of FIG. 22 positioned in a holster on a user's hip.
Figure 23B:
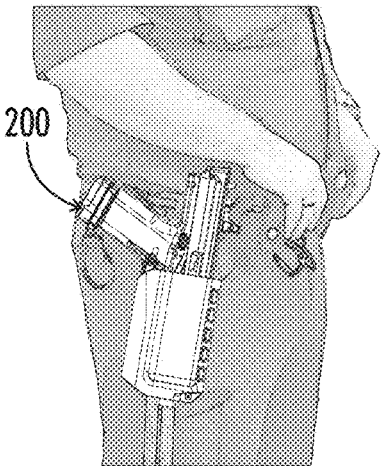
FIG. 23B is a perspective view of the compact rifle-caliber firearm of FIG. 9 positioned in a holster on a user's hip.
Figure 23C:
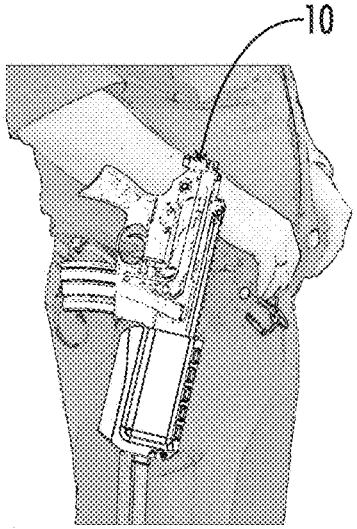
FIG. 23C is a perspective view of the forward-fed firearm of FIG. 1 positioned in a holster on a user's hip.

Referring to FIGS. 22-23C, a comparison of each of the compact rifle-caliber firearm 200, the forward-fed firearm 10, and the pistol 90 positioned in holsters is shown. Specifically, FIG. 22, shows the relative, "to scale," size of each of the compact rifle-caliber firearm 200, the forward-fed firearm 10, and the pistol 90 when positioned in a holster. As can best be seen in FIG. 23A, the pistol 90 is shown in a holster as positioned on a user's hip in order to show the holsterability of the pistol 90. As can best be seen in FIG. 23B, the compact rifle-caliber firearm 200 is shown in a holster as positioned on a user's hip. As can be seen, the compact rifle-caliber firearm 200, while larger than the pistol is easily holsterable. As can best be seen in FIG. 23C, the forward-fed firearm 10 is shown in a holster as positioned on a user's hip. As shown, the size and relative position on the user of the forward-fed firearm 10 make it not well suited to be used in conjunction with a holster. As such, the forward-fed firearm 10 is considered not holsterable.

Figure 24:
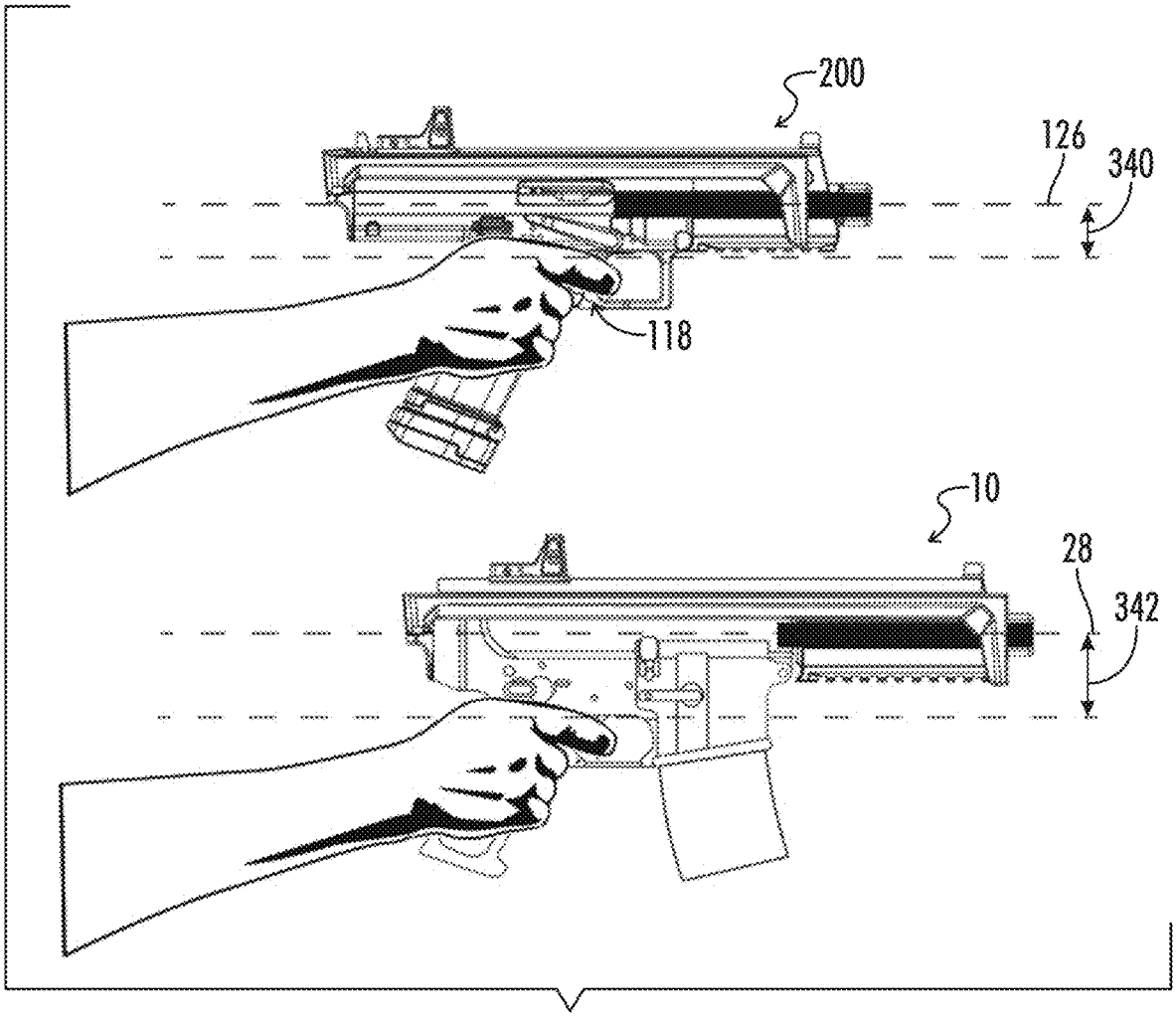
FIG. 24 is a comparison of the bore axis height for the compact rifle-caliber firearm of FIG. 9 and the forward-fed firearm of FIG. 1.

Referring to FIG. 24, a comparison of the bore axis height for the compact rifle-caliber firearm 200 and the forward-fed firearm 10 is shown. The compact rifle-caliber firearm 200 includes a vertical offset 340 between the bore axis 126 and the trigger 114. A vertical offset 342 between the bore axis 28 and the trigger of the forward-fed firearm 10 is shown. The vertical offset 340 of the compact rifle-caliber firearm 200 is advantageously smaller than the vertical offset 342 of the forward-fed firearm 10. This reduced vertical offset has numerous benefits, one of which is a reduction in the upward kick of the compact rifle-caliber firearm 200 when cycling rounds through it.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful FIREARM, it is not intended that such references be construed as limitations upon the scope of this disclosure except as set forth in the following claims.

What is claimed is:

1. A magazine for a compact rifle-caliber firearm comprising:

a magazine operable to be inserted within a grip of the compact rifle-caliber firearm and operable to receive rifle cartridges;

the magazine including:

a forward wall with an interior forward wall surface and an exterior forward wall surface;

a rearward wall with a ridgeless interior rearward wall surface and an exterior rearward wall surface;

feed lips at a feed lip angle relative to an uppermost portion of the rearward wall; and an exterior magazine depth between the exterior forward wall surface and the exterior rearward wall surface; and an interior magazine depth between the interior forward wall surface and the interior rearward wall surface, the interior magazine depth being less than a cartridge length of at least one of the rifle cartridges the magazine is operable to receive.

2. The magazine of claim 1, wherein the exterior magazine depth is less than the cartridge length of at least one of the rifle cartridges the magazine is operable to receive.

3. The magazine of claim 1, wherein the interior magazine depth is less than about fifty-seven (57) millimeters.

4. The magazine of claim 1, wherein the magazine is operable to receive a first cartridge about parallel to the feed lips and a second cartridge angled greater than about zero-point-five (0.5) degrees relative to the feed lips.

5. The magazine of claim 4, wherein the magazine is operable to receive a third cartridge angled greater than about one (1) degree relative to the feed lips.

6. The magazine of claim 1, wherein the magazine further comprises a follower, the follower having an upper surface angled from about thirty-five (35) degrees to about forty-five (45) degrees relative to the interior rearward wall surface.

7. The magazine of claim 6, wherein the upper surface of the follower includes a fixed angle forward portion and a pivotal rearward portion biased to align with the feed lips of the magazine, the fixed angle forward portion angled relative to the feed lips relative to the interior rearward wall surface.

8. The magazine of claim 1, wherein the magazine is operable to position a first cartridge about parallel to the feed lips with a distal tip of the cartridge extending beyond the forward interior wall surface.

9. The magazine of claim 1, further comprising the magazine being operable to angle at least some rifle cartridges relative to the feed lips with successive rifle cartridges of the at least some rifle cartridges angled at a greater angle than preceding rifle cartridges.

10. The magazine of claim 9, wherein the successive rifle cartridges are angled at about zero-point-five (0.5) degrees greater than the preceding rifle cartridges.

11. A magazine for a compact rifle-caliber firearm comprising:

a magazine operable to be inserted within a grip of the compact rifle-caliber firearm and operable to receive rifle cartridges;

the magazine including:

a forward wall with an interior forward wall surface and an exterior forward wall surface;

a rearward wall with an interior rearward wall surface and an exterior rearward wall surface, the interior rearward wall surface fixed relative to the exterior rearward wall surface;

feed lips at a feed lip angle relative to an uppermost portion of the rearward wall; and an exterior magazine depth between the exterior forward wall surface and the exterior rearward wall surface; and an interior magazine depth between the interior forward wall surface and the interior rearward wall surface, the interior magazine depth being less than a cartridge length of at least one of the rifle cartridges the magazine is operable to receive.

12. The magazine of claim 11, wherein the exterior magazine depth is less than the cartridge length of at least one of the rifle cartridges the magazine is operable to receive.

13. The magazine of claim 11, wherein the interior magazine depth is less than about fifty-seven (57) millimeters.

14. The magazine of claim 11, wherein the magazine is operable to receive a first cartridge about parallel to the feed lips and a second cartridge angled greater than about zero-point-five (0.5) degrees relative to the feed lips.

15. The magazine of claim 14, wherein the magazine is operable to receive a third cartridge angled greater than about one (1) degree relative to the feed lips.

16. The magazine of claim 11, wherein the magazine further comprises a follower, the follower having an upper surface angled from about thirty-five (35) degrees to about forty-five (45) degrees relative to the interior rearward wall surface.

17. The magazine of claim 16, wherein the upper surface of the follower includes a fixed angle forward portion and a pivotal rearward portion biased to align with the feed lips of the magazine, the fixed angle forward portion angled relative to the feed lips relative to the interior rearward wall surface.

18. The magazine of claim 11, wherein the magazine is operable to position a first cartridge about parallel to the feed lips with a distal tip of the cartridge extending beyond the forward interior wall surface.

19. The magazine of claim 11, further comprising the magazine being operable to angle at least some rifle cartridges relative to the feed lips with successive rifle cartridges of the at least some rifle cartridges angled at a greater angle than preceding rifle cartridges.

20. The magazine of claim 19, wherein the successive rifle cartridges are angled at about zero-point-five (0.5) degrees greater than the preceding rifle cartridges.

* * * * *